US006991332B1

(12) United States Patent
Fan et al.

(10) Patent No.: US 6,991,332 B1
(45) Date of Patent: Jan. 31, 2006

(54) DIGITAL HAND STAMP WITH MEMORY TO STORE MULTIPLE IMAGES

(76) Inventors: Nong-Qiang Fan, P.O. Box 280763, San Francisco, CA (US) 94128-0763; Jie Xiao, P.O. Box 280763, San Francisco, CA (US) 94128-0763

( * ) Notice: Subject to any disclaimer, the term of this patent is extended or adjusted under 35 U.S.C. 154(b) by 0 days.

(21) Appl. No.: 10/428,177

(22) Filed: May 2, 2003

(51) Int. Cl.
*B41J 3/36* (2006.01)

(52) U.S. Cl. ..... 347/109; 347/108

(58) Field of Classification Search ..... 347/2, 347/108, 109, 101, 104, 8; 400/88, 691; 358/493

See application file for complete search history.

(56) References Cited

U.S. PATENT DOCUMENTS 4,436,439 A * 3/1984 Koto ..... 347/108
5,024,541 A 6/1991 Tsukada et al.
5,063,451 A * 11/1991 Yanagisawa et al. ..... 346/143
5,517,916 A 5/1996 Dour et al.
5,634,730 A 6/1997 Bobry
5,743,186 A 4/1998 Liao
5,853,251 A * 12/1998 Imai ..... 400/88
5,988,900 A * 11/1999 Bobry ..... 347/109
6,543,893 B2 4/2003 Desormeaux
6,674,543 B2 1/2004 Day et al.
6,815,723 B2 * 11/2004 Yamazaki et al. ..... 257/88
2002/0018108 A1 * 2/2002 Day et al. ..... 347/108

* cited by examiner

*Primary Examiner*—Manish S. Shah

(57) ABSTRACT

A digital hand stamp that can print multiple images on a supporting surface. The digital hand stamp includes a frame member, an ink jet printing head, a non-volatile memory, an image selection button, a display area, and a printing control circuit. The frame member has a cavity. The ink jet printing head has one or more nozzles. The ink jet printing head can be activated to slide inside the cavity of the frame member when the digital hand stamp is pressed against the supporting surface. The non-volatile memory can store a plurality of images. The image selection button can select an image from the plurality of images stored in the non-volatile memory. The display area can display the image selected by the selection button. The printing control circuit controls the nozzles on the ink jet printing head to project an ink pattern on the supporting surface when the ink jet printing head slides inside the cavity of the frame member. The ink pattern on the supporting surface represents the image selected by the image selection button.

41 Claims, 17 Drawing Sheets

DIGITAL HAND STAMP WITH MEMORY TO STORE MULTIPLE IMAGES

BACKGROUND

The present invention relates generally to a digital hand stamp, and more particularly to a digital hand stamp with a memory to store multiple images.

FIG. 1 shows a conventional hand stamp 10 that can be used to imprint a word "PAID" on a supporting surface 50. Conventional hand stamp 10 includes a frame member 14 and an operating member 12. Operating member 12 is operatively associated with frame member 14. A stamp plate 16 is attached to the end of frame member 14. A mirror image of the word "PAID" is inscribed on stamp plate 16.

When several words or images are to be imprinted, conventional stamp 10 is not very convenient. For example, if one needs to imprint two words "PAID" and "VOID", one may have to use two stamps: one stamp for imprinting word "PAID" and one stamp for imprinting word "VOID". Alternatively, one may use one stamp and attach on the stamp a stamp plate that is selected from two stamp plates: one stamp plate for imprinting word "PAID" and one stamp plate for imprinting word "VOID".

A digital hand stamp that can imprint multiple images clearly has advantages over the conventional hand stamp 10.

SUMMARY

In one aspect, the invention is directed to a digital hand stamp that can print multiple images on a supporting surface. The digital hand stamp includes a frame member, an ink jet printing head, a non-volatile memory, an image selection button, a display area, and a printing control circuit. The frame member has a cavity. The ink jet printing head has one or more nozzles. The ink jet printing head can be activated to slide inside the cavity of the frame member when the digital hand stamp is pressed against the supporting surface. The non-volatile memory can store a plurality of images. The image selection button can select an image from the plurality of images stored in the non-volatile memory. The display area can display the image selected by the selection button. The printing control circuit controls the nozzles on the ink jet printing head to project an ink pattern on the supporting surface when the ink jet printing head slides inside the cavity of the frame member. The ink pattern on the supporting surface represents the image selected by the image selection button.

Implementations of the invention may include one or more of the following features. The display area can include a liquid crystal display or an organic light emitting display. The image displayed on the display area can have the same size as an image imprinted on the supporting surface. The image displayed on the display area can have a size different from the size of an image imprinted on the supporting surface. The non-volatile memory can be a flash memory, a ROM or other solid sate non-volatile memory. The digital hand stamp can have a socket operable to receive a removable memory storage media. The non-volatile memory can include a removable memory storage media. The removable memory storage media can be a flash memory card, a smart memory card, or a memory stick.

The digital hand stamp can include an activation button. Pressing the activation button can activate the ink jet printing head to slide inside the cavity of the frame member. The ink jet printing head can be activated automatically to slide inside the cavity of the frame member when the digital hand stamp is pressed against the supporting surface. The digital hand stamp can include an operating member and the ink jet printing can be activated automatically to slide inside the cavity of the frame member when the frame member moves relative to the operating member by a distance larger than a threshold. The digital hand stamp can include a leg and the ink jet printing head can be activated automatically to slide inside the cavity of the frame member when the leg moves relative to the frame member by a distance larger than a threshold.

The digital hand stamp can include a plurality of imaging editing buttons operable to edit an image that is to be imprinted on the supporting surface. The digital hand stamp can include a plurality of letter keys operable to select a letter, a number or a word that is to be imprinted on the supporting surface. The digital hand stamp can include an indicator operable to indicate that the ink jet printing head finishes printing the ink pattern on the supporting surface. The ink jet printing head can be a color ink jet printing head. The ink jet printing head can include a protection cover for protecting the ink jet printing head. The digital hand stamp can include one or more markers for specifying a position that the ink pattern is printed on the supporting surface.

In another aspect, the invention is directed to a method of printing an image on a supporting surface using a digital hand stamp. The digital hand stamp has a non-volatile memory and a display area. The method includes storing a plurality of images in the non-volatile memory. The method includes selecting the image from the plurality of images stored in the non-volatile memory by pressing an image selection button on the digital hand stamp. The method includes displaying the image selected by the image selection button on the display area. The method includes holding the digital hand stamp against the supporting surface. The method includes activating an ink jet printing head to slide inside a cavity on a frame member of the digital hand stamp. The method includes controlling nozzles on the ink jet printing head to project an ink pattern on the supporting surface when the ink jet printing head slides inside the cavity of the frame member. The ink pattern on the supporting surface represents the image selected by the selection button.

Implementations of the invention may include one or more of the following features. The display area can include a liquid crystal display or an organic light emitting display. The method can include displaying on the display area an image that has the same size as an image imprinted on the supporting surface. The method can include displaying on the display area an image that has a size different from the size of an image imprinted on the supporting surface. The method can include storing the plurality of images in a flash memory, a ROM or other solid sate non-volatile memories. The method can include providing a socket to receive a removable memory storage media as the non-volatile memory. The non-volatile memory can be selected from a group consisting of a flash memory card, a smart memory card, and a memory stick.

The method can include pressing an activation button to activate the ink jet printing head to slide inside the cavity of the frame member when the digital hand stamp is pressed against the supporting surface. The method can include pressing the digital hand stamp against the supporting surface to activate the ink jet printing head to slide inside the cavity of the frame member automatically. The method can include moving the frame member relative to an operating member by a distance larger than a threshold to activate the ink jet printing head to slide inside the cavity of the frame member automatically. The method can include moving a leg relative to the frame member by a distance larger than a threshold to activate the ink jet printing head to slide inside the cavity of the frame member automatically.

The method can include editing an image that is to be imprinted on the supporting surface with a plurality of imaging editing buttons. The method can include editing a letter, a number or a word that is to be imprinted on the supporting surface with a plurality of letter keys. The method can include lifting the digital hand stamp when an indicator on the digital hand stamp indicates that that the ink jet printing head finishes printing the ink pattern on the supporting surface. The ink jet printing head can be a color ink jet printing head. The method can include protecting the ink jet printing head with a protection cover. The method can include specifying a position that the ink pattern is printed on the supporting surface with one or more markers on the digital hand stamp.

In another aspect, the invention is directed to a digital hand stamp that can print an image of an object on a supporting surface. The digital hand stamp includes a frame member, an ink jet printing head, a non-volatile memory, an image selection button, a display area, and a printing control circuit. The frame member has a cavity. The ink jet printing head has one or more nozzles. The ink jet printing head can be activated to slide inside the cavity of the frame member when the digital hand stamp is pressed against the supporting surface. The non-volatile memory stores an image and a name for each of a plurality of objects. The image selection button can select an object from the plurality of objects. The display area displays the name of the object selected by the image selection button. The printing control circuit controls the nozzles on ink jet printing head to project an ink pattern on the supporting surface when the ink jet printing head slides inside the cavity of the frame member. The ink pattern on the supporting surface represents the image of the object selected by the image selection button.

In another aspect, the invention is directed to a digital hand stamp that can print a name of an object on a supporting surface. The digital hand stamp includes a frame member, an ink jet printing head, a non-volatile memory, an image selection button, a display area, and a printing control circuit. The frame member has a cavity. The ink jet printing head has one or more nozzles. The ink jet printing head can be activated to slide inside the cavity of the frame member when the digital hand stamp is pressed against the supporting surface. The non-volatile memory stores an image and a name for each of a plurality of objects. The image selection button can select an object from the plurality of objects. The display area displays the image of the object selected by the image selection button. The printing control circuit controls the nozzles on ink jet printing head to project an ink pattern on the supporting surface when the ink jet printing head slides inside the cavity of the frame member. The ink pattern on the supporting surface represents the name of the object selected by the image selection button.

In another aspect, the invention is directed to a method for teaching a child to learn the name of an object using a digital hand stamp. The digital hand stamp has a non-volatile memory and a display area. The method includes storing a name and an image for each of a plurality of objects in the non-volatile memory. The method includes selecting the object from the plurality of objects. The method includes selecting a name of the object using an image selection button on the digital hand stamp. The method includes displaying the name of the object selected by the image selection button on the display area. The method includes holding the digital hand stamp against a supporting surface. The method includes activating an ink jet printing head to slide inside a cavity on a frame member of the digital hand stamp. The method includes controlling nozzles on the ink jet printing head to project an ink pattern on the supporting surface when the ink jet printing head slides inside the cavity of the frame member. The ink pattern on the supporting surface represents the image of the object selected by the image selection button.

In another aspect, the invention is directed to a method for teaching a child to learn the name of an object using a digital hand stamp. The digital hand stamp has a non-volatile memory and a display area. The method includes storing a name and an image for each of a plurality of objects in the non-volatile memory. The method includes selecting the object from the plurality of objects. The method includes selecting an image of the object using an image selection button on the digital hand stamp. The method includes displaying the image of the object selected by the image selection button on the display area. The method includes holding the digital hand stamp against a supporting surface. The method includes activating an ink jet printing head to slide inside a cavity on a frame member of the digital hand stamp. The method includes controlling nozzles on the ink jet printing head to project an ink pattern on the supporting surface when the ink jet printing head slides inside the cavity of the frame member. The ink pattern on the supporting surface represents the name of the object selected by the image selection button.

Implementations of the invention may include one or more of the following advantages. The digital hand stamp can print multiple images. The digital hand stamp can be operated as a stand-alone device without attaching to a personal computer or a digital camera. When the digital hand stamp is operated as a stand-alone device, it can be carried around more easily, and it can also be more useful in field applications. The digital hand stamp has the advantage of keeping images during power-off period; this advantage makes the digital hand stamp more useful and friendly to users.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The present invention will be understood more fully from the detailed description and accompanying drawings of the invention set forth herein. However, the drawings are not to be construed as limiting the invention to the specific embodiments shown and described herein. Like reference numbers are designated in the various drawings to indicate like elements.

DETAILED DESCRIPTION

Figure 1:
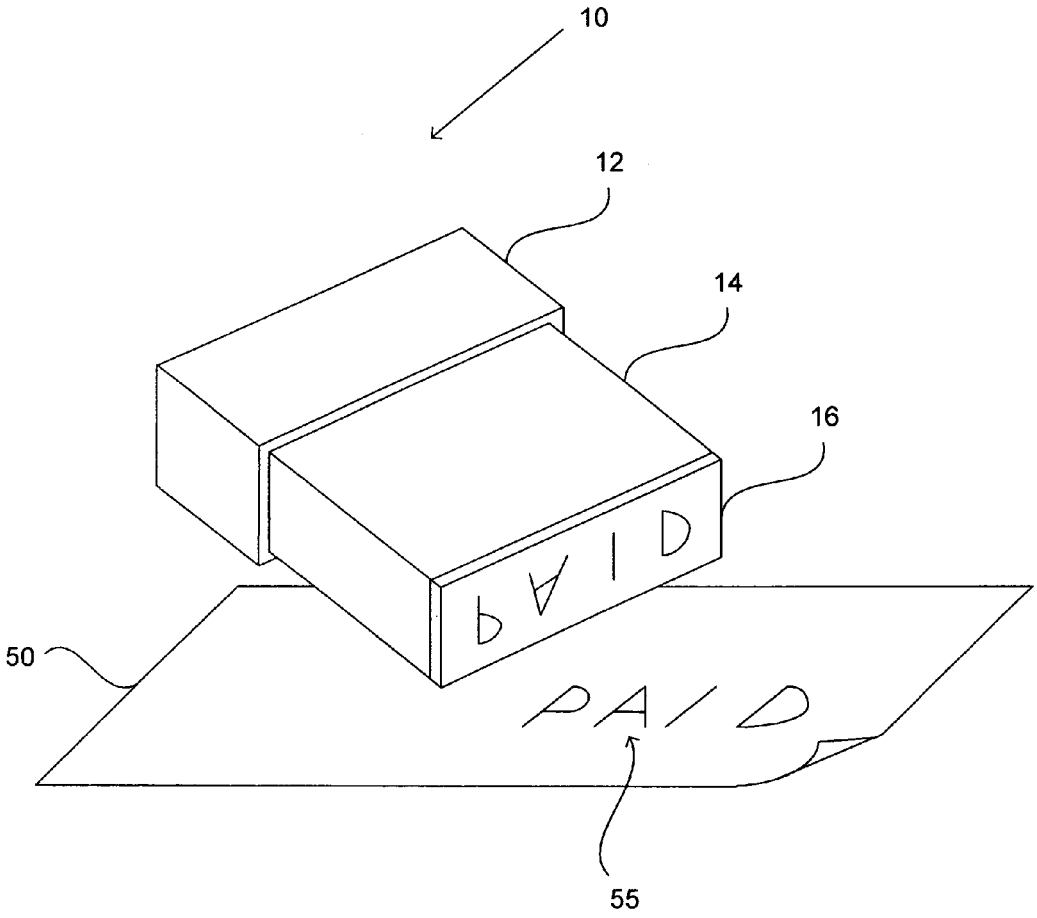
FIG. 1 shows a conventional stamp for imprinting a word "PAID" on a supporting surface.
Figure 2:
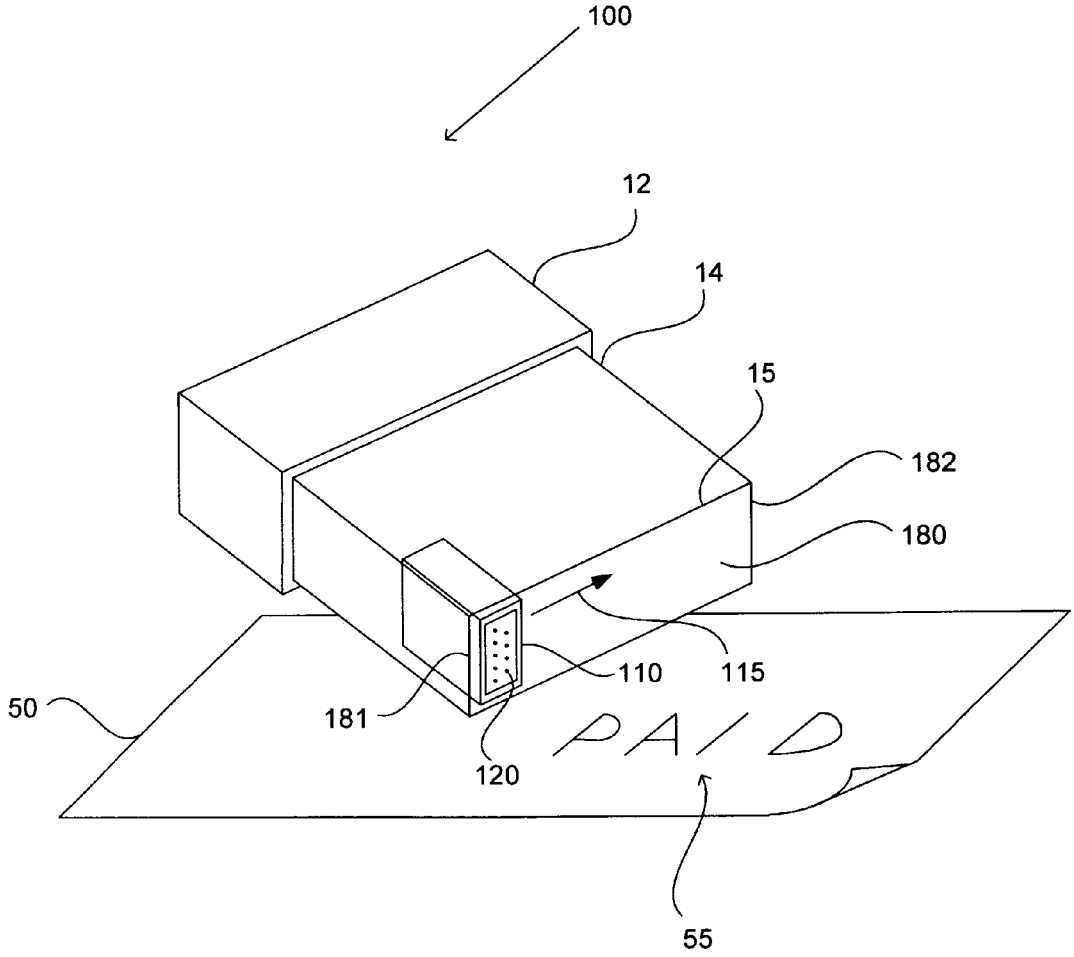
FIG. 2 shows a digital hand stamp for imprinting multiple images on a supporting surface.

FIG. 2 shows a digital hand stamp 100 that can imprint multiple images on a supporting surface 50. Digital hand stamp 100 includes a frame member 14 and an operating member 12. Operating member 12 is operatively associated with frame member 14. Frame member 14 includes a lower end 15 that is intended to bear against supporting surface 50. Frame member 14 includes a cavity 180. Cavity 180 can be rectangular in shape.

Digital hand stamp 100 also includes an ink jet printing head 10 having one or more nozzles 120. These nozzles 120 can be aligned in an array pattern, a matrix pattern or other defined patterns. An ink jet can be projected from a nozzle under the control of an external variable, such as an electrical signal. Ink jet printing head 110 can include a printing cartridge. Ink jet printing head 110 is installed in cavity 180. Cavity 180 includes a first end 181 and a second end 182. Ink jet printing head 110 can slide in a direction 115 from first end 181 to second end 182.

Figure 3A:
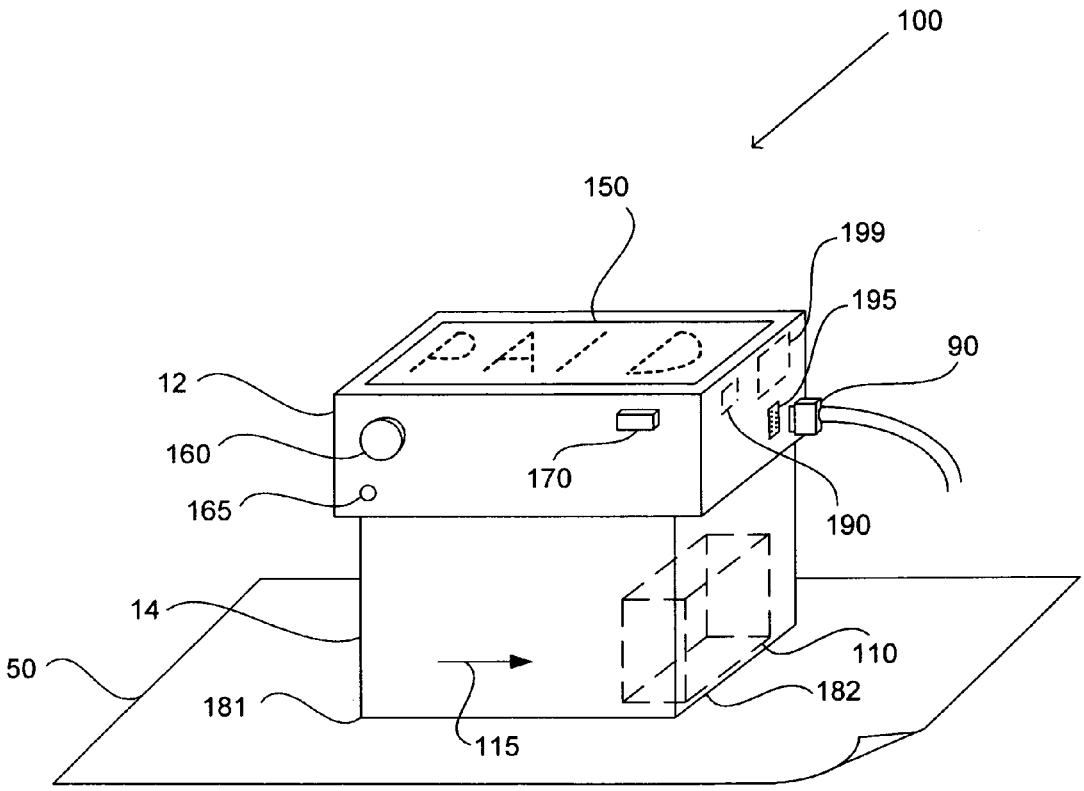
FIG. 3*a* shows that a digital hand stamp is pressed against a supporting surface and an ink jet printing head is activated to slide in a cavity.

As shown in FIG. 3*a*, when digital hand stamp 100 is pressed against supporting surface 50, ink jet printing head 110 can be activated to slide in direction 115 from first end 181 to second end 182. Ink jet printing head 110 can be activated to slide in direction 115 by pressing an activation button 160. Ink jet printing head 110 can also be activated automatically when digital hand stamp 100 is pressed against supporting surface 50. While ink jet printing head 110 is sliding in direction 115, the nozzles 120 on ink jet printing head 110 project ink patterns on supporting surface 50 under the control of a printing control circuit 199. After ink jet printing head 110 slide from first end 181 to second end 182, an ink pattern determined by printing control circuit 199 is imprinted on supporting surface 50.

Digital hand stamp 100 can include an indicator 165, such as an LED, to indicate that ink jet printing head 110 has finished sliding from first end 181 to second end 182 and that an ink pattern has been imprinted on supporting surface 50. The indicator 165 enable a user to lift digital hand stamp 100 from supporting surface 50 just after a complete ink pattern has been imprinted on supporting surface 50.

Figure 3B:
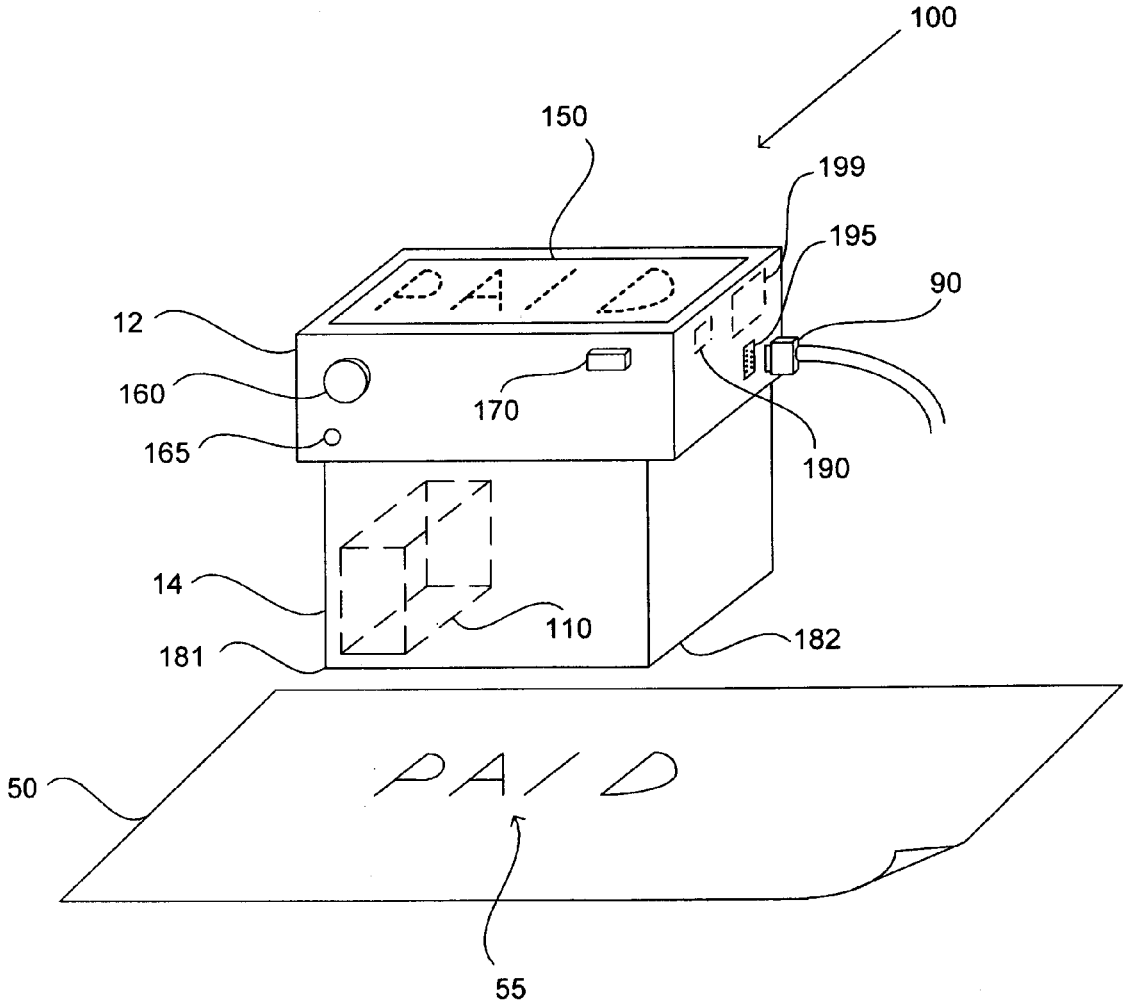
FIG. 3*b* shows that a digital hand stamp is lifted from a supporting surface and an image "PAID" is imprinted on the supporting surface.

As shown in FIG. 3*b*, when digital hand stamp 100 is lifted from supporting surface 50 after the printing process in FIG. 3*a*, an ink pattern 55, such as an image "PAID", is imprinted on supporting surface 50.

Because printing control circuit 199 controls the ink pattern to be imprinted, digital hand stamp 100 can easily imprint different ink patterns on supporting surface 50. For example, after digital hand stamp 100 prints an image "PAID", if digital hand stamp 100 is pressed again on supporting surface 50, digital hand stamp 100 can be programmed to print an image "VOID" under the control of printing control circuit 199.

Ink jet printing head 110 can be a color ink jet printing head. With a color ink jet printing head, digital hand stamp 100 can print either monochromic or color images.

Digital hand stamp 100 generally includes a memory 190 operable to store multiple images. Digital hand stamp 100 can also include an image selection button 170 to select one of the multiple images stored in memory 190. The selected image can be displayed in a display area 150. Display area 150 can display the image to be imprinted on supporting surface 50. Display area 150 can also display general instructions. Implementations of display area 150 can include a liquid crystal display ("LCD") or an organic light emitting display ("OLED").

In one implementation, the image displayed on display area 150 has the same size as the image imprinted on supporting surface 50. In another implementation, the image displayed on the display area 150 is proportional to the image imprinted on supporting surface 50 but has a size different from the size of the image imprinted on supporting surface 50.

FIG. 3*a* shows that digital hand stamp 100 can include a digital interface 195 for connecting digital hand stamp 100 with another digital device such as a personal computer or a digital camera through an interface connector 90. When digital hand stamp 100 is connected to a personal computer, the ink patterns to be imprinted on supporting surface 50 can be edited on the personal computer or down loaded from the personal computer. When digital hand stamp 100 is connected to a digital camera, the ink patterns to be imprinted on supporting surface 50 can be the same imaging patterns as captured by the digital camera.

Digital hand stamp 100 can also include one or more imaging editing buttons (not shown in the figure). Image editing buttons can be used to edit the image that is to be imprinted on supporting surface 50. As a specific example, image editing buttons can be letter keys to select the letters, numbers or words to be imprinted on supporting surface 50. As another specific example, image editing buttons can be used to enlarge or shrink proportionally an image to be imprinted on supporting surface 50.

Memory 190 can be a non-volatile memory, such as a flash memory or a ROM. Memory 190 can also be a removable memory storage media, such as a flash memory card, a smart memory card, or a memory stick. Digital hand stamp 100 can include a socket (not shown in the figure) for receiving a removable memory storage media. A variety of other kinds of solid state non-volatile memory can be also be used as memory 190.

When memory 190 is a non-volatile memory, digital hand stamp 100 can be operated as a stand-alone device without attaching to a personal computer or a digital camera. When digital hand stamp 100 is operated as a stand-alone device, it can be carried around more easily, and it can also be more useful in field applications. When memory 190 is a non-volatile memory, the multiple images stored in digital hand stamp 100 can be still kept intact when the power on the digital hand stamp 100 is turned off. This advantage of keeping images during power-off period makes the digital hand stamp 100 more useful and friendly to users.

Figure 4A:
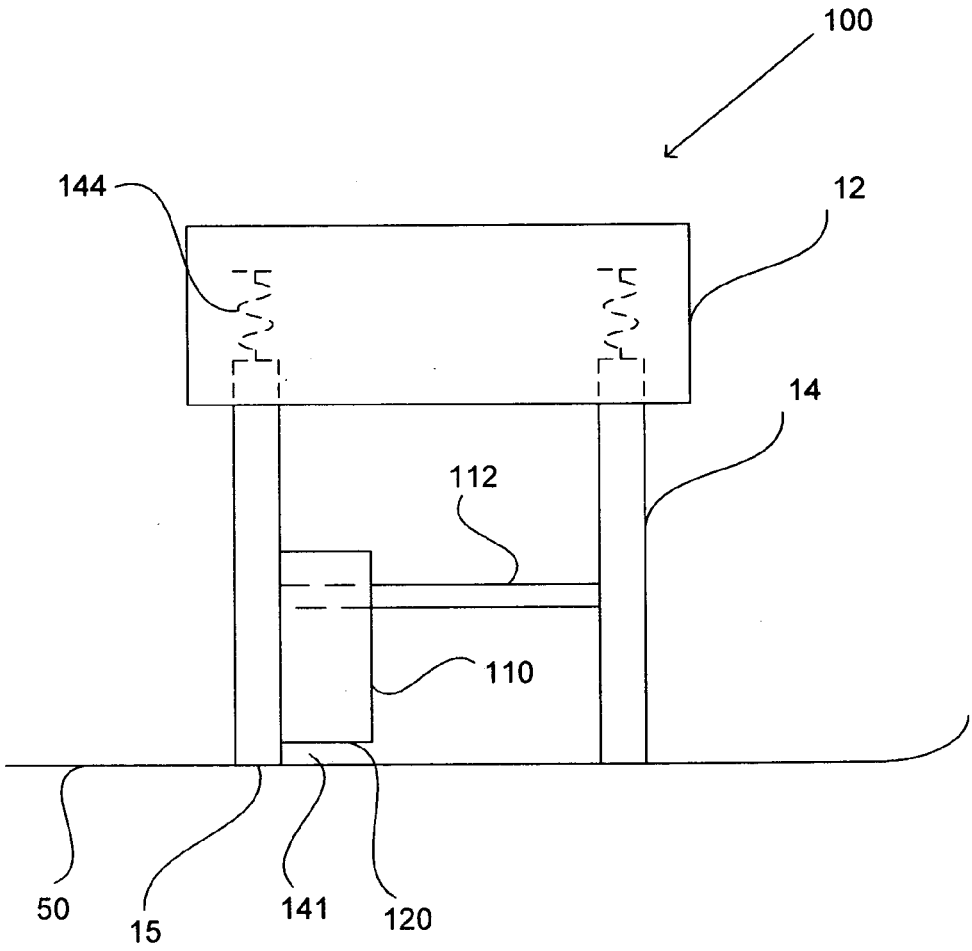
FIGS. 4*a* and 4*b* show a first sample implementation to enable an ink jet printing bead be activated to slide in a cavity automatically.
Figure 4B:
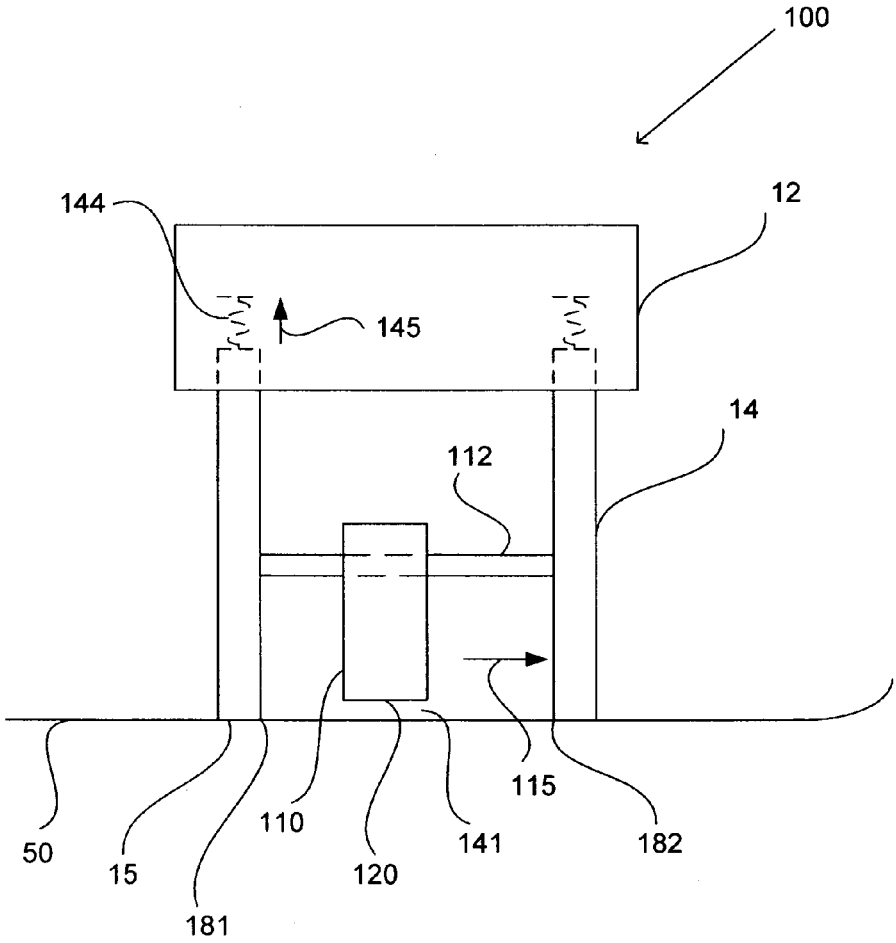
Figure 5A:
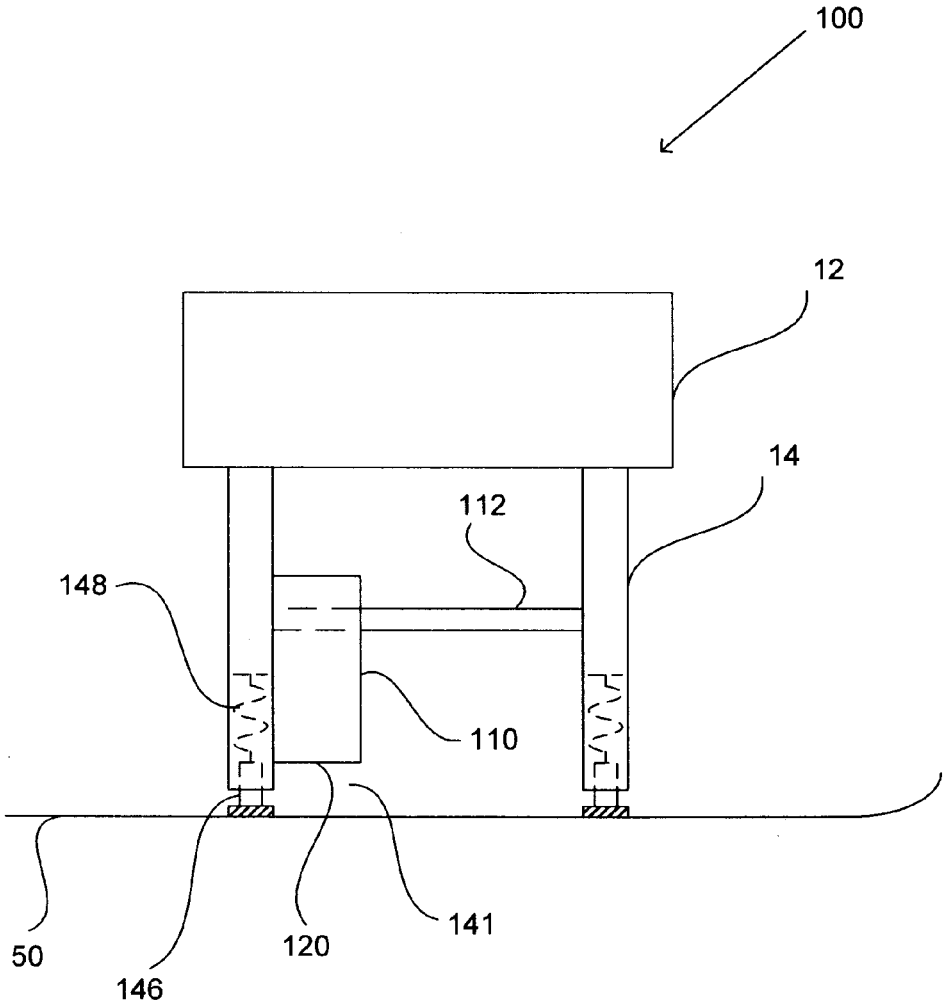
FIGS. 5*a* and 5*b* show a second sample implementation to enable an ink jet printing head be activated to slide in a cavity automatically.
Figure 5B:
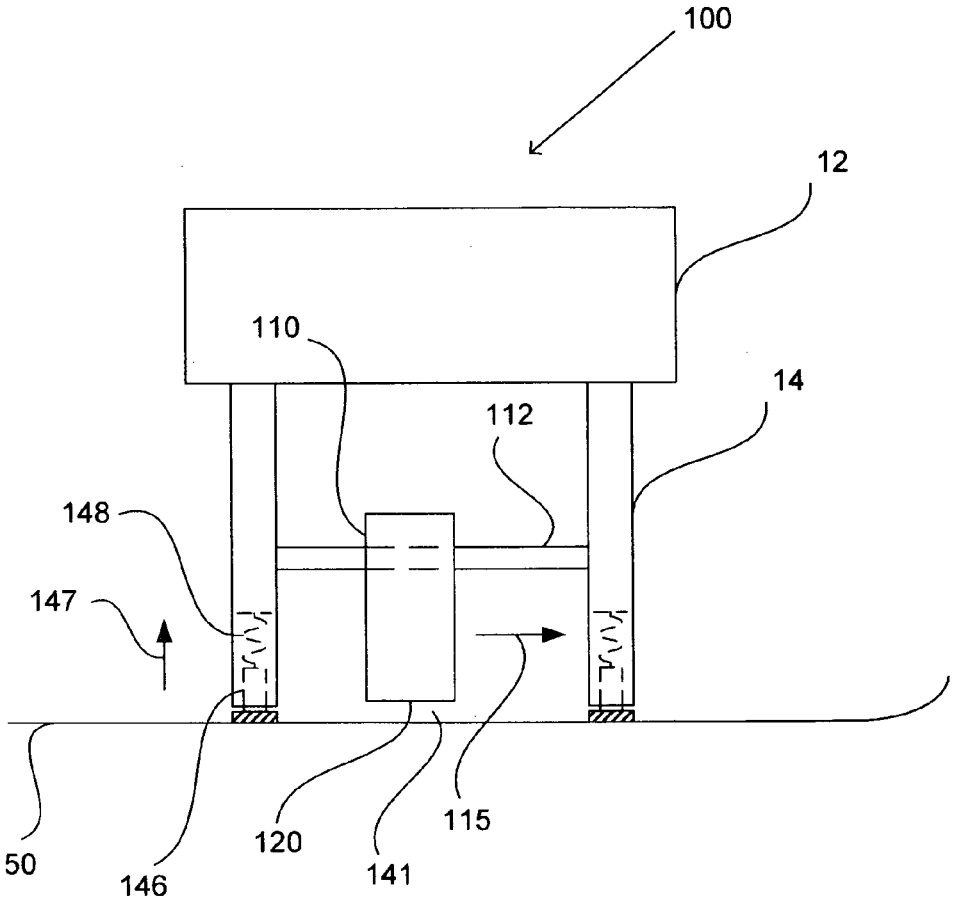

In FIG. 3*a*, ink jet printing head 110 can be activated to slide in direction 115 by pressing an activation button 160. Ink jet printing head 110 can be also activated automatically when digital hand stamp 100 is pressed against supporting surface 50. Many possible implementations are possible to enable ink jet printing head 110 be activated to slide in direction 115 automatically. FIGS. 4*a* and 4*b* show a first sample implementation. FIGS. 5*a* and 5*b* show a second sample implementation.

In FIGS. 4*a* and 4*b*, frame member 14 can move relative to operating member 12. Ink jet printing head 110 can slide along a sliding guide 112. Sliding guide 112 is fixed relative to operating member 12. Frame member 14 is biased against operating member 12 by a spring 144 such that a predetermined distance 141 exits between nozzles 120 and lower end 15. As shown in FIG. 4*b*, when digital hand stamp 100 is pushed against supporting surface 50, the length of spring 144 shrinks and frame member 14 moves relative to operating member 12 in a direction 145 as indicated in the figure. As frame member 14 moves relative to operating member 12, distance 141 decreases at the same time. When distance 141 is smaller than a threshold value and nozzles 120 is at a suitable distance to project inks onto supporting surface 50, ink jet printing head 110 is activated to slide in direction 115 and project ink patterns onto supporting surface 50 as controlled by printing control circuit 199.

Figure 4C:
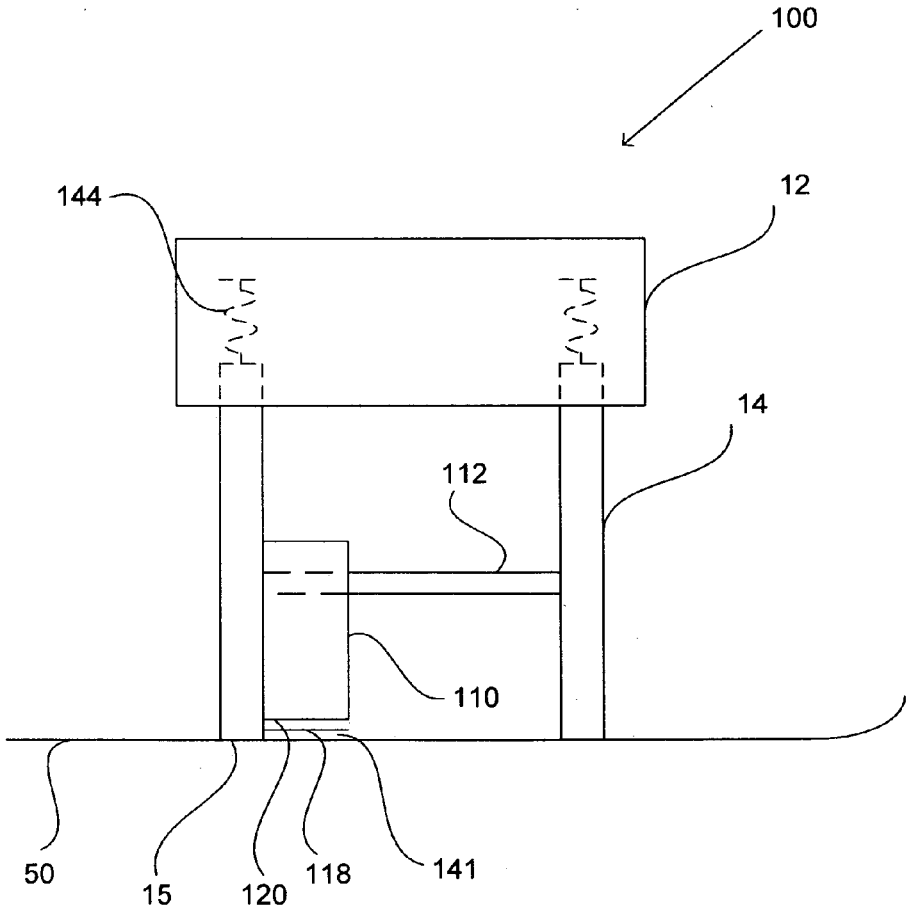
FIG. 4*c* shows that a digital hand stamp includes a protection cover for protecting the ink jet printing head.

FIG. 4*c* shows that digital hand stamp 100 can include a protection cover 118 for protecting ink jet printing head 110. Before digital hand stamp 100 is pressed against supporting surface 50, ink jet printing head 110 generally is at a position that nozzles 120 are protected by protection cover 118. Ink jet printing head 110 can slide along direction 115 to imprint an ink pattern on supporting surface 50. After ink jet printing head 110 finishes printing the ink pattern on supporting surface, ink jet printing head 110 again returns to a position that nozzles 120 are protected by protection cover 118.

In FIGS. 5*a* and 5*b*, frame member 14 is fixed relative to operating member 12. Ink jet printing head 110 can slide along a sliding guide 112. Sliding guide 112 is also fixed relative to operating member 12. Digital hand stamp 100 includes a leg 146 that is intended to bear against supporting surface 50. Leg 146 can move relative to frame member 14. Leg 146 is biased against frame member 14 by a spring 148 such that a predetermined distance 141 exits between nozzles 120 and supporting surface 50. As shown in FIG. 5*b*, when digital hand stamp 100 is pushed against supporting surface 50, the length of spring 148 shrinks and leg 146 moves relative to frame member 14 in a direction 147 as indicated in the figure. As leg 146 moves relative to frame member 14, distance 141 decreases at the same time. When distance 141 is smaller than a threshold value and nozzles 120 is at a suitable distance to project inks onto supporting surface 50, ink jet printing head 110 is activated to slide in direction 115 and project ink patterns onto supporting surface 50 as controlled by printing control circuit 199.

Figure 6A:
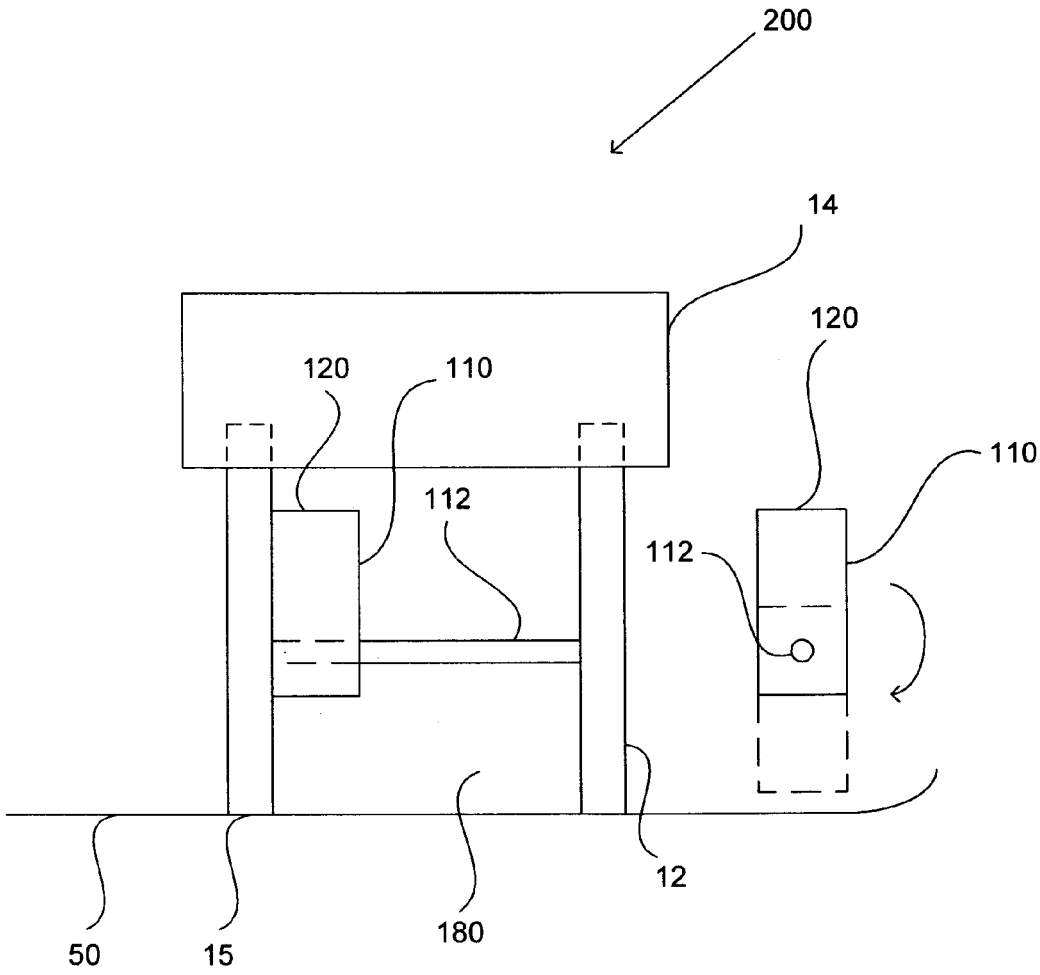
FIGS. 6*a* and 6*b* show an implementation of a digital hand stamp that uses designs similar to a self-inking stamp to enable an ink jet printing head be activated to slide in a cavity automatically.
Figure 6B:
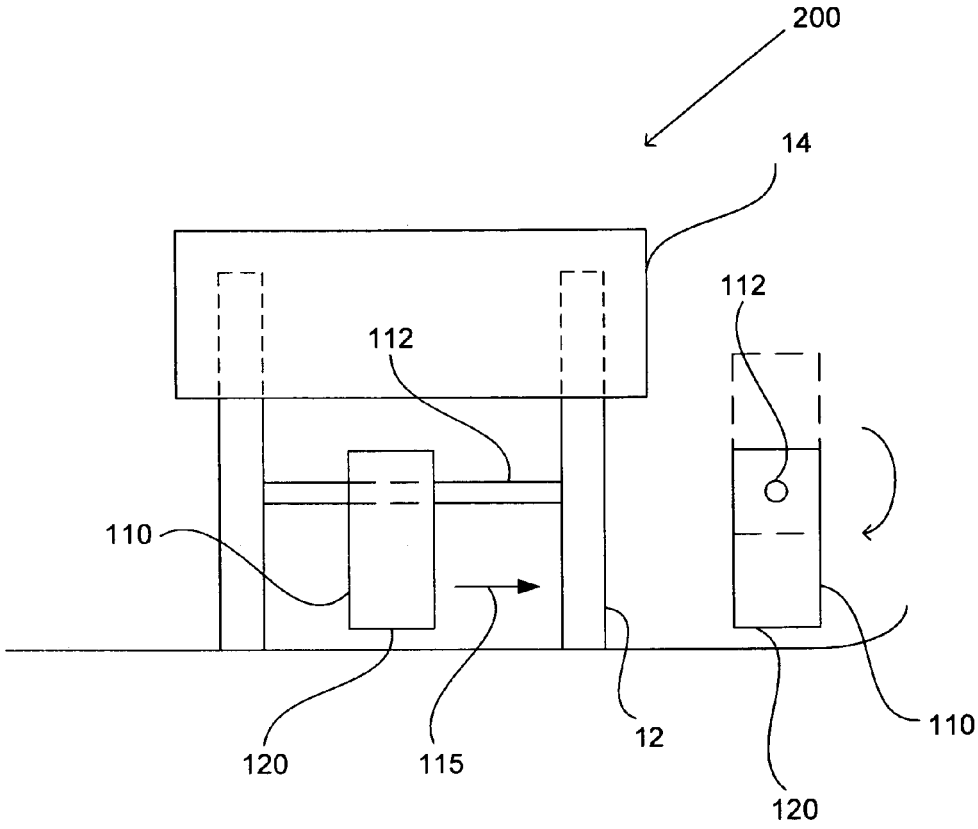

FIGS. 6*a* and 6*b* show an implementation of a digital hand stamp 200 that uses designs similar to some of the self-inking stamps to enable ink jet printing head 110 be activated to slide in direction 115. Digital hand stamp 200 includes a frame member 14 and an operating member 12. Operating member 12 is operatively associated with frame member 14. Frame member 14 includes a lower end 15 that is intended to bear against supporting surface 50. Frame member 14 includes a cavity 180. Cavity 180 can be rectangular in shape. Digital hand stamp 100 also includes an ink jet printing head 110 having one or more nozzles 120. Ink jet printing head 110 can slide along a sliding guide 112.

Before digital hand stamp 200 is pressed against supporting surface 50, ink jet printing head 110 is orientated in a direction such that nozzles 120 faces towards operating member 12. As digital hand stamp 200 is pressed against supporting surface 50, ink jet printing head 110 is flipped, for example, by about 180 degrees, and changes the orientation to a direction such that nozzles 120 faces towards supporting surface 50.

When nozzles 120 faces towards supporting surface 50, ink jet printing head 110 can be activated to slide in direction 115 from first end 181 to second end 182 and project ink patterns onto supporting surface 50 as controlled by printing control circuit 199.

The designs of how to flip ink jet printing head 110 when digital hand stamp 200 is pressed against supporting surface 50 can be similar to those designs used in some of the self-inking stamps, for example, as described in U.S. Pat. No. 5,517,916 and U.S. Pat. No. 5,743,186.

Figure 7:
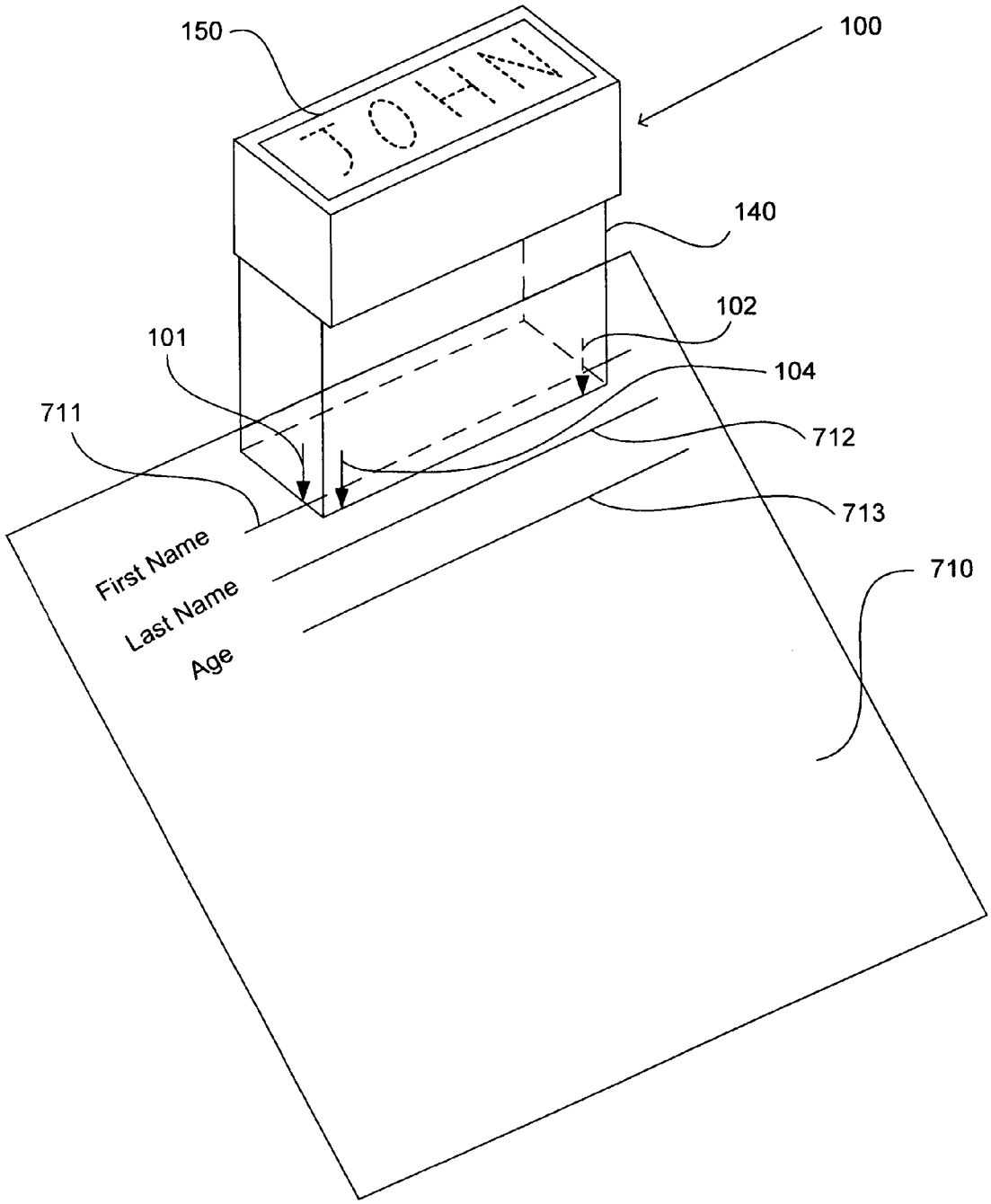
FIG. 7 shows that a digital hand stamp is used to fill up entries on a paper form.

A digital hand stamp with a memory for storing multiple images can have variety of applications. FIG. 7 shows that a digital hand stamp 100 is used to fill up entries on a paper form 710. The paper form 710 includes three entries: an entry 711 for "First Name", an entry 712 for "Last Name", an entry 713 for "Age". If three images representing words "JOHN", "SMITH", and "32" are stored in the memory in digital hand stamp 100, then, entries 711, 712, and 713 can be filled up, respectively, with "JOHN", "SMITH", and "32". More specifically, FIG. 7 shows that an image representing word "JOHN" is imprinted in a corresponding area on paper form 710 for entry 711, "First Name".

As shown in FIG. 7, digital hand stamp 100 can include one or more alignment markers for positioning digital hand stamp 100 correctly on paper form 710. For example, digital hand stamp 100 can include markers 101 and 102 for aligning digital hand stamp 100 horizontally with paper form 710. Digital hand stamp 100 can also include a marker 103 to enable each word be imprinted in the correct position in each of the entry in paper form 710. Markers 101, 102, and 103 can be on the sidewalls of frame member 14. Markers 101, 102, and 103 generally can be used to specify the position and the orientation of the image that is to be imprinted on a supporting surface.

Digital hand stamp 100 can also be modified to become a toy for children. For example, digital hand stamp 100 can be loaded with multiple colorful images that children like to draw or print on a piece of paper. Examples of these colorful images include dogs, cats, mice, fishes, ducks, chicken, tigers, cats, flowers, sun, and moon. These colorful images can be stored in memory 190 on digital hand stamp 100. An image selection button 170 on digital hand stamp 100 can be used to select which one of the colorful images in memory 190 is to be printed.

Figure 8A:
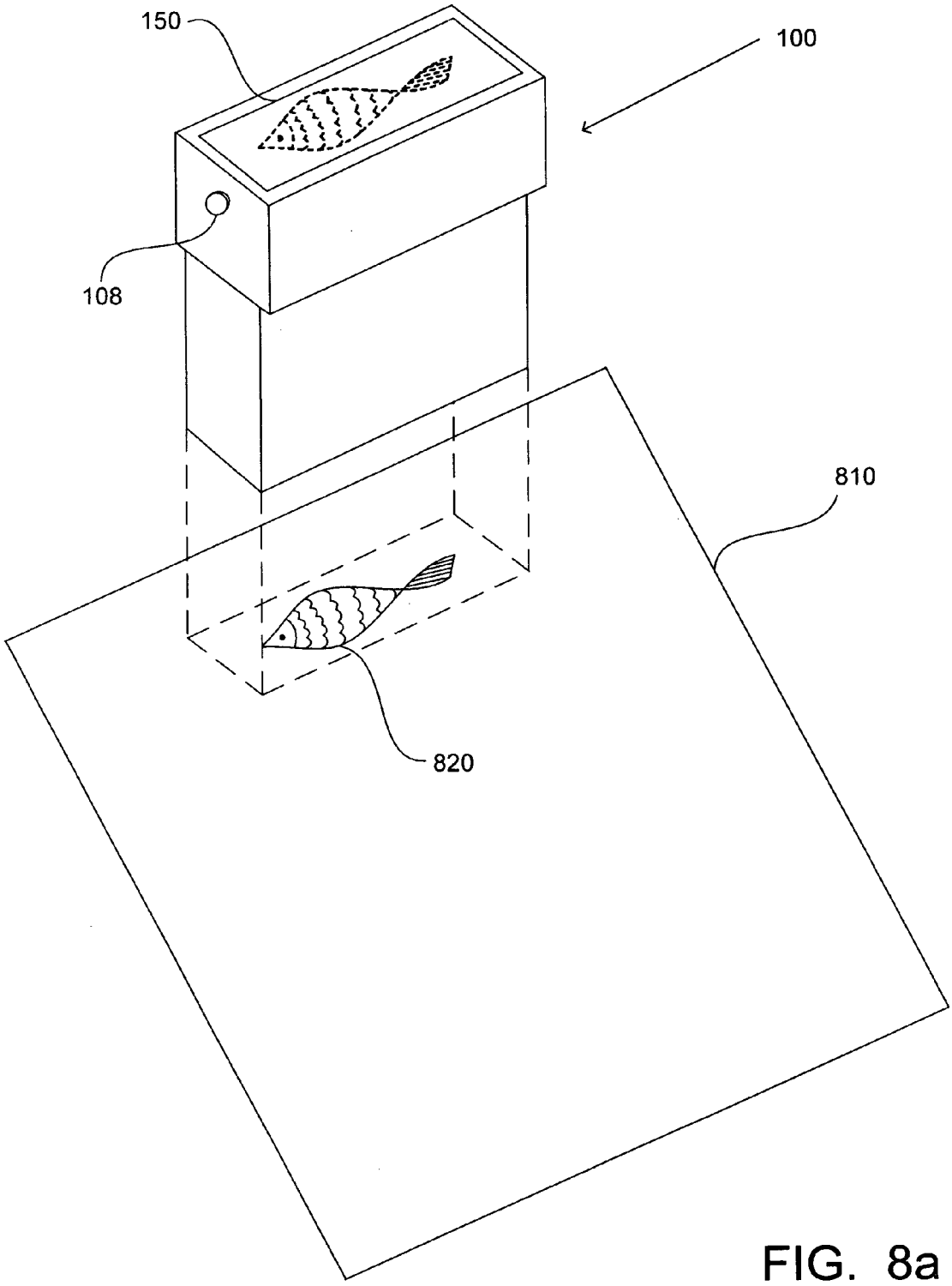
FIG. 8*a* shows that an image of a fish is printed on a piece of paper.

Digital hand stamp 100 can include a display area 150 to display the image that is to be printed. FIG. 8*a* shows that an image of a fish 820 is printed on a piece of paper 810. The image of fish is also displayed in display area 150. Digital hand stamp 100 can also include a speaker 108. When an image of an object is printed on the piece of paper 810, the name of the object can be pronounced by speaker 108 at the same time.

Figure 8B:
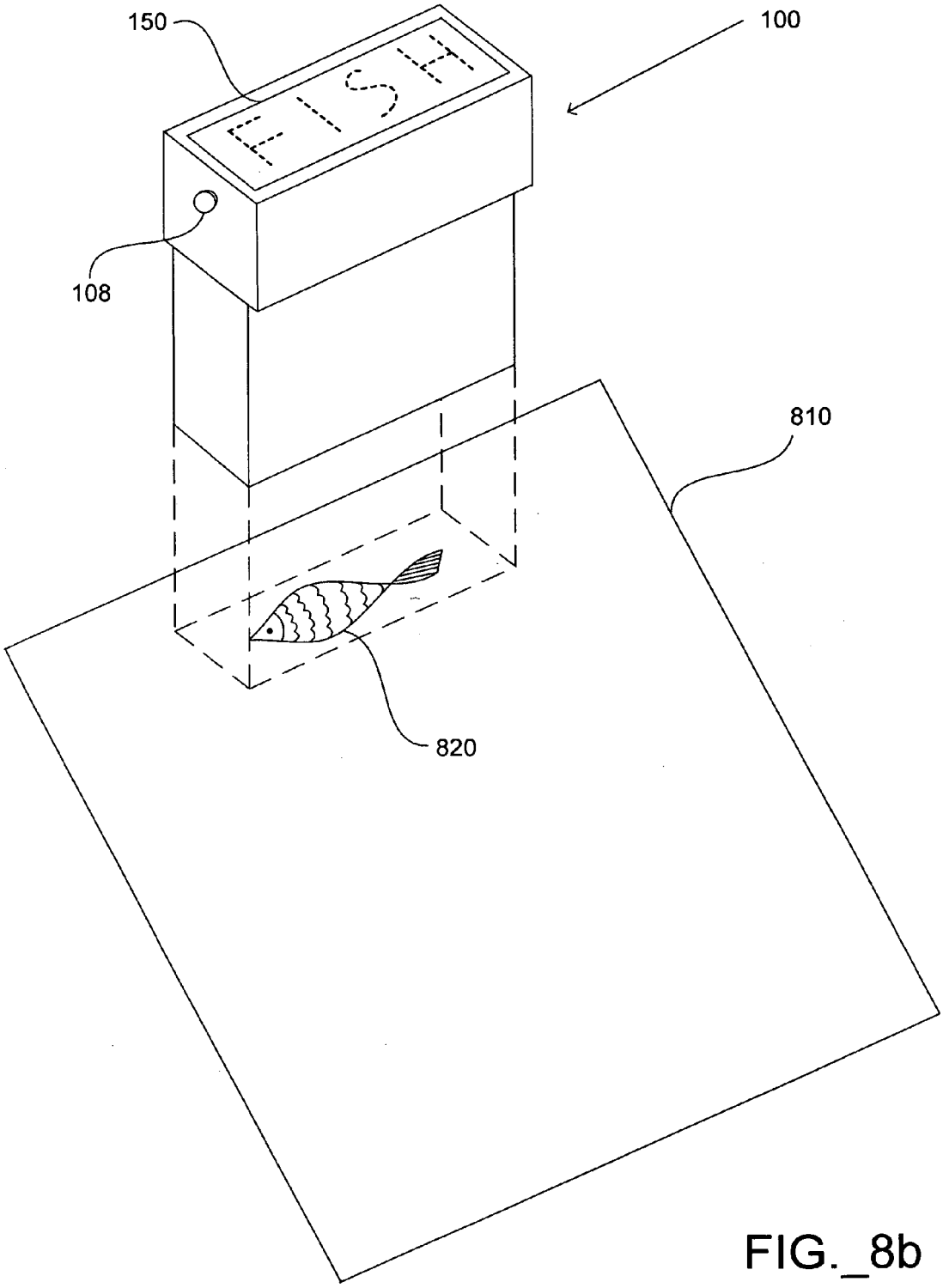
FIG. 8*b* shows that a word "FISH" is displayed in a display area and an image of a fish is printed on a piece of paper.
Figure 8C:
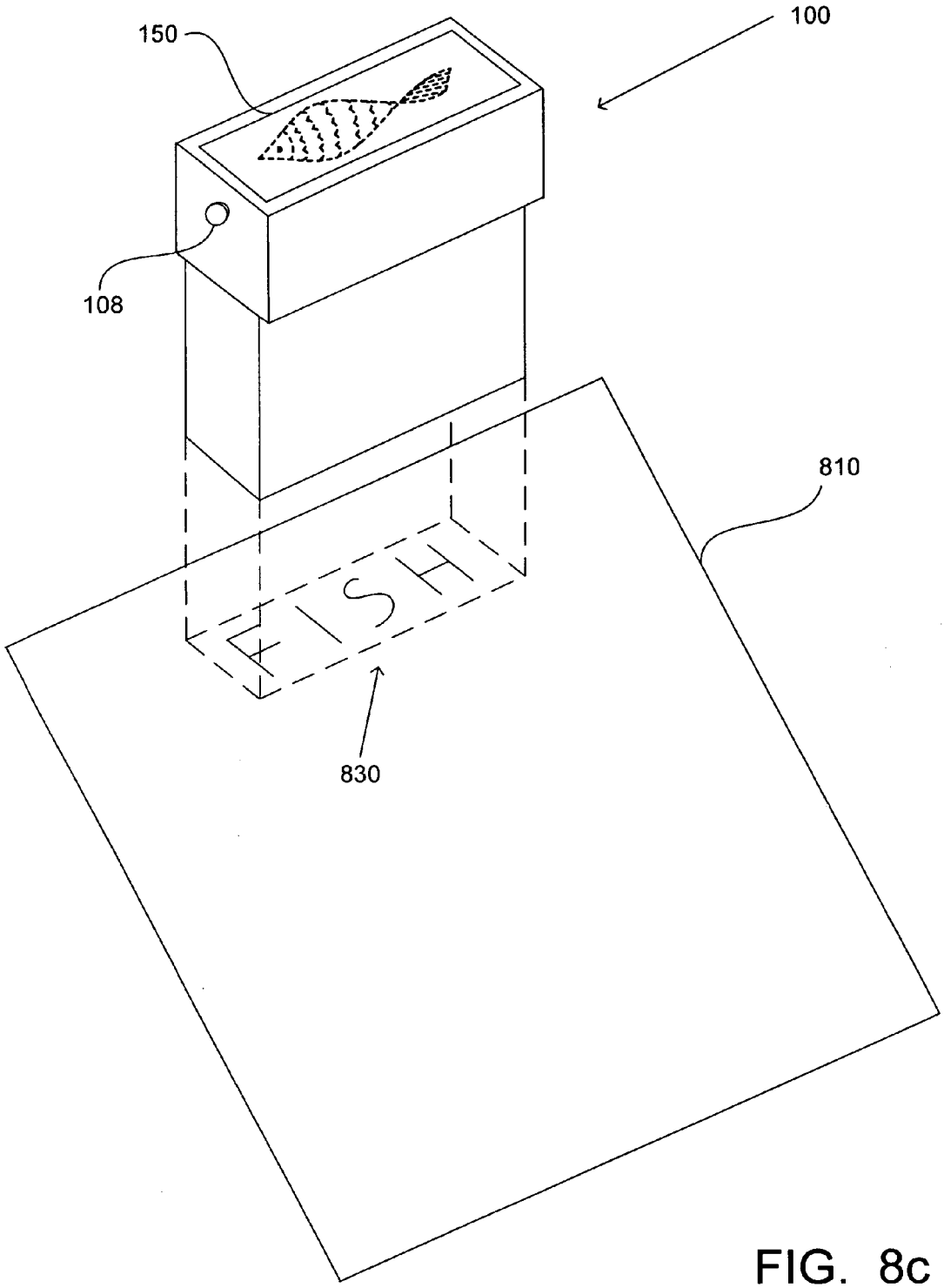
FIG. 8*c* shows that an image of a fish is displayed in a display area and a word "FISH" is printed on a piece of paper.

In another implementation, instead of displaying in display are 150 the image of an object that is to be printed, the name of the object can be displayed in display area 150. For example, FIG. 8*b* shows that a word "FISH" is displayed in display area 150 and an image of fish is printed on a piece of paper 810. Memory 190 in digital hand stamp 100 can store the images of a list of objects and the names of the list of objects. A user can use image selection button 170 to select the name of an object to, be printed while the name of the object is displayed in display area 150. A user can also use letter keys (not shown in the figure) to enter the name of an object to be printed. After the selection, when digital hand stamp 100 is pushed against the piece of paper 810, the corresponding image of the selected object can be printed. Speaker 108 can pronounce the name of the selected object at the same time. With this implementation, digital hand stamp 100 essentially can be used as a picture dictionary. In yet another implementation, an image of an object is displayed in display area 150 and the name of the object 830 is printed on a piece of paper 810. For example, FIG. 8*c* shows that an image of a fish is displayed in display area 150 and a word "FISH" is printed on a piece of paper 810. A user can use image selection button 170 to select the image of an object to be printed while the image of the object is displayed in display area 150. After the selection, when digital hand stamp 100 is pushed against the piece of paper 810, the corresponding name of the selected object can be printed. Speaker 108 can pronounce the name of the selected object at the same time.

Figure 9A:
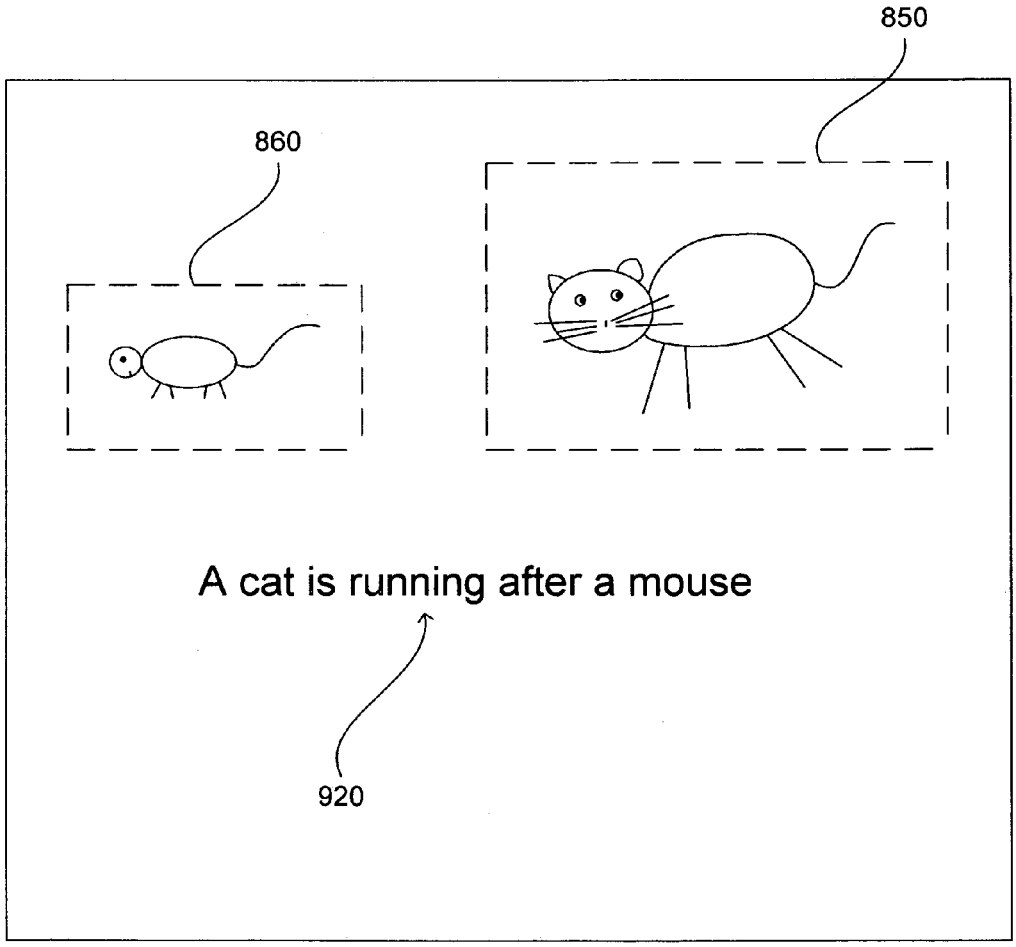
FIG. 9*a* shows that a child can use a digital hand stamp to draw pictures.

FIG. 9*a* shows that a child can use digital hand stamp 100 to draw pictures. As shown in FIG. 9*a*, when a child is asked to illustrate a sentence 920 that states "a cat is running after a mouse", the child can print an image of cat 850 and an image of mouse 860. The child also needs to position the two images at the correct positions.

Figure 9B:
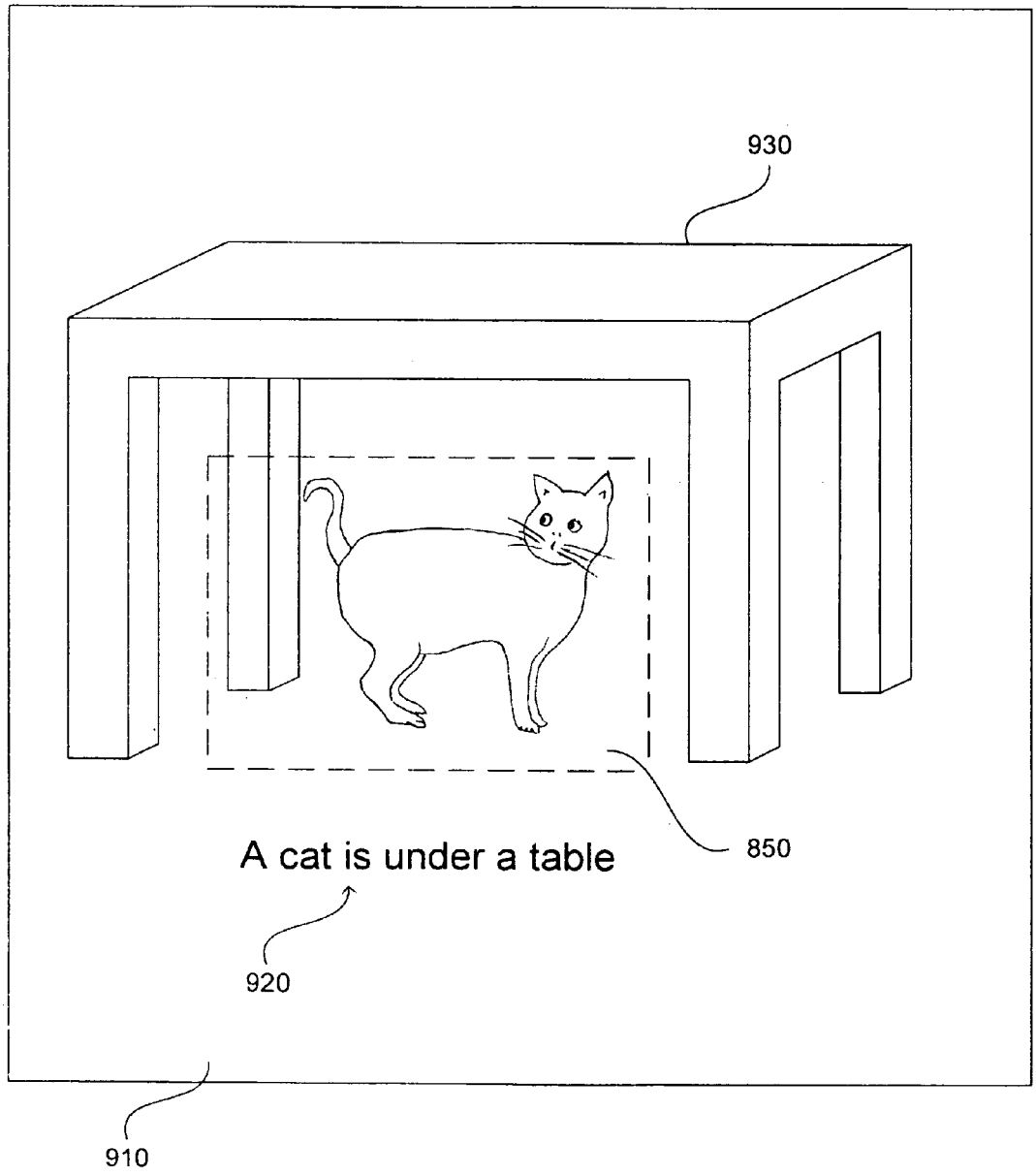
FIG. 9*b* shows that a child can use a digital hand stamp to modify a picture book.

FIG. 9*b* shows that a child can use digital hand stamp 100 to modify a picture book. In FIG. 9*b*, a page 910 on a picture book includes a table 930. When a child is asked to modify the page 910 to illustrate a sentence 920 that states "a cat is under a table", the child need to print an image of cat 850 at the correct position.

When a picture book tells a story that includes several characters, digital hand stamp 100 can be used by a child to finish the drawings on each page of the picture book. For this purpose, the images of the characters can be stored in digital hand stamp 100 and each page of the picture book can be provided with either complete drawings or partial drawings; a child is asked to complete those partial drawings.

Based on above teachings, other applications are also possible for the digital hand stamp with a memory.

The present invention has been described in terms of a number of implementations. The invention, however, is not limited to the implementations depicted and described. Rather, the scope of the invention is defined by the appended claims.

The invention claimed is:

1. A digital hand stamp operable to print multiple images on a supporting surface, comprising:

a frame member having a cavity;

a sliding guide inside the cavity;

an ink jet printing head having one or more nozzles, the ink jet printing head operable to be activated automatically to slide along the sliding guide inside the cavity of the frame member when the digital hand stamp is pressed against the supporting surface;

a non-volatile memory operable to store a plurality of images;

an image selection button operable to select an image from the plurality of images stored in the non-volatile memory;

a display area operable to display the image selected by the selection button; and a printing control circuit controlling the nozzles on the ink jet printing head to project an ink pattern on the supporting surface when the ink jet printing head slides inside the cavity of the frame member, wherein the ink pattern on the supporting surface represents the image selected by the image selection button.

2. The digital hand stamp of claim 1 wherein the display area includes any one of a liquid crystal display and an organic light emitting display.

3. The digital hand stamp of claim 1 wherein the image displayed on the display area has the same size as an image imprinted on the supporting surface.

4. The digital hand stamp of claim 1 wherein the image displayed on the display area has a size different from the size of an image imprinted on the supporting surface.

5. The digital hand stamp of claim 1 wherein the non-volatile memory includes a solid sate non-volatile memory.

6. The digital hand stamp of claim 1 wherein the non-volatile memory includes a flash memory.

7. The digital hand stamp of claim 1 wherein the non-volatile memory includes a ROM.

8. The digital hand stamp of claim 1 further comprising a socket operable to receive a removable memory storage media.

9. The digital hand stamp of claim 1 wherein the non-volatile memory includes a removable memory storage media.

10. The digital hand stamp of claim 9 wherein the removable memory storage media is selected from a group consisting of a flash memory card, a smart memory card, and a memory stick.

11. The digital hand stamp of claim 1 further comprising an operating member, wherein the frame member is movable relative to the operating member, the ink jet printing head operable to be activated automatically to slide inside the cavity of the frame member when the frame member moves relative to the operating member by a distance larger than a threshold.

12. The digital hand stamp of claim 1 further comprising a leg movable relative to the frame member, the ink jet printing head operable to be activated automatically to slide inside the cavity of the frame member when the leg moves relative to the frame member by a distance larger than a threshold.

13. The digital hand stamp of claim 1 further comprising a plurality of imaging editing buttons operable to edit an image that is to be imprinted on the supporting surface.

14. The digital hand stamp of claim 1 further comprising a plurality of letter keys operable to select a letter, a number or a word that is to be imprinted on the supporting surface.

15. The digital hand stamp of claim 1 further comprising a LED indicator operable to indicate that the ink jet printing head finishes printing the ink pattern on the supporting surface.

16. The digital hand stamp of claim 1 wherein the ink jet printing head is a color ink jet printing head.

17. The digital hand stamp of claim 1 further comprising a protection cover for protecting the ink jet printing head.

18. The digital hand stamp of claim 1 further comprising one or more markers for specifying a position that the ink pattern is printed on the supporting surface.

19. The digital hand stamp of claim 1 wherein the display area is on a top face of the digital hand stamp such that the display area is substantially parallel to the supporting surface when digital hand stamp is pressed against the supporting surface.

20. A method of printing an image on a supporting surface using a digital hand stamp having a non-volatile memory and a display area, the method comprising:

storing a plurality of images in the non-volatile memory;

selecting the image from the plurality of images stored in the non-volatile memory by pressing an image selection button on the digital hand stamp;

displaying the image selected by the image selection button on the display area;

holding the digital hand stamp against the supporting surface;

pressing the digital hand stamp against the supporting surface to activate an ink jet printing head to slide automatically inside a cavity on a frame member of the digital hand stamp while keeping a substantially constant distance between the ink jet printing head and the supporting surface; and controlling nozzles on the ink jet printing head to project an ink pattern on the supporting surface when the ink jet printing head slides inside the cavity of the frame member, wherein the ink pattern on the supporting surface represents the image selected by the selection button.

21. The method of claim 20 wherein the display area includes any one of a liquid crystal display and an organic light emitting display.

22. The method of claim 20 wherein the displaying includes displaying on the display area an image that has the same size as an image imprinted on the supporting surface.

23. The method of claim 20 wherein the displaying includes displaying on the display area an image that has a size different from the size of an image imprinted on the supporting surface.

24. The method of claim 20 wherein the storing includes storing the plurality of images in a solid sate non-volatile memory.

25. The method of claim 20 wherein the storing includes storing the plurality of images in a flash memory.

26. The method of claim 20 wherein the storing includes storing the plurality of images in a ROM.

27. The digital hand stamp of claim 20 further comprising providing a socket to receive a removable memory storage media as the non-volatile memory.

28. The method of claim 20 wherein the storing includes storing the plurality of images in a removable memory storage media.

29. The method of claim 28 wherein the storing includes storing the plurality of images in a removable memory storage media that is selected from a group consisting of a flash memory card, a smart memory card, and a memory stick.

30. The method of claim 20 further comprising moving the frame member relative to a operating member by a distance larger than a threshold to activate the ink jet printing head to slide inside the cavity of the frame member automatically.

31. The method of claim 20 further comprising moving a leg relative to the frame member by a distance larger than a threshold to activate the ink jet printing head to slide inside the cavity of the frame member automatically.

32. The method of claim 20 further comprising editing an image that is to be imprinted on the supporting surface with a plurality of imaging editing buttons.

33. The method of claim 20 further comprising editing a letter, a number or a word that is to be imprinted on the supporting surface with a plurality of letter keys.

34. The method of claim 20 further comprising lifting the digital hand stamp when a LED indicator on the digital hand stamp indicates that that the ink jet printing head finishes printing the ink pattern on the supporting surface.

35. The method of claim 20 wherein the ink jet printing head is a color ink jet printing head.

36. The method of claim 20 further comprising protecting the ink jet printing head with a protection cover.

37. The method of claim 20 further comprising specifying a position that the ink pattern is printed on the supporting surface with one or more markers on the digital hand stamp.

38. A digital hand stamp operable to print multiple images on a supporting surface, comprising:

a frame member having a cavity;

a sliding guide inside the cavity;

an inkjet printing head having one or more nozzles, the ink jet printing head operable to be activated automatically to slide along the sliding guide inside the cavity of the frame member when the digital hand stamp is pressed against the supporting surface;

a memory operable to store a plurality of images;

an image selection button operable to select an image from the plurality of images stored in the memory;

a display area operable to display the image selected by the selection button; and a printing control circuit controlling the nozzles on the ink jet printing head to project an ink pattern on the supporting surface when the ink jet printing head slides inside the cavity of the frame member, wherein the ink pattern on the supporting surface represents the image selected by the image selection button.

39. A digital hand stamp operable to print multiple images on a supporting surface, comprising:

a frame member having a cavity;

an ink jet printing head having one or more nozzles, the ink jet printing head operable to be activated automatically to slide inside the cavity of the frame member when the digital hand stamp is pressed against the supporting surface, and wherein the ink jet printing head maintains a substantially constant distance with respect to the supporting surface while sliding inside the cavity of the frame member;

a non-volatile memory operable to store a plurality of images;

an image selection button operable to select an image from the plurality of images stored in the non-volatile memory;

a display area operable to display the image selected by the selection button; and a printing control circuit controlling the nozzles on the ink jet printing head to project an ink pattern on the supporting surface when the ink jet printing head slides inside the cavity of the frame member, wherein the ink pattern on the supporting surface represents the image selected by the image selection button.

40. The digital hand stamp of claim 39 wherein the display area is on a top face of the digital hand stamp such that the display area is substantially parallel to the supporting surface when digital hand stamp is pressed against the supporting surface.

41. A method of printing an image on a supporting surface using a digital hand stamp having a non-volatile memory and a display area, the method comprising:

storing a plurality of images in the non-volatile memory;

selecting the image from the plurality of images stored in the non-volatile memory by pressing an image selection button on the digital hand stamp;

displaying the image selected by the image selection button on the display area;

holding the digital hand stamp against the supporting surface;

pressing the digital hand stamp against the supporting surface to activate an ink jet printing head to slide automatically along a sliding guide inside a cavity on a frame member of the digital hand stamp; and controlling nozzles on the ink jet printing head to project an ink pattern on the supporting surface when the ink jet printing head slides inside the cavity of the frame member, wherein the ink pattern on the supporting surface represents the image selected by the selection button.

* * * * *

UNITED STATES PATENT AND TRADEMARK OFFICE

CERTIFICATE OF CORRECTION

PATENT NO. : 6,991,332 B1
DATED : January 31, 2006
INVENTOR(S) : Nong-qiang Fan and Jie Xiao It is certified that error appears in the above-identified patent and that said Letters Patent is hereby corrected as shown below:

The drawing sheets showing FIG. 4a, FIG. 4c, FIG. 6a, FIG. 6b and FIG. 7 should be deleted and replaced with the attached pages.

Column 5,
Line 41, replace “head 10” with -- head 110 --.

Column 9,
Line 2, replace “play are” with -- play area --.
Line 9, replace “an object to,” with -- an object to --.

Signed and Sealed this

Thirtieth Day of May, 2006

JON W. DUDAS
*Director of the United States Patent and Trademark Office*

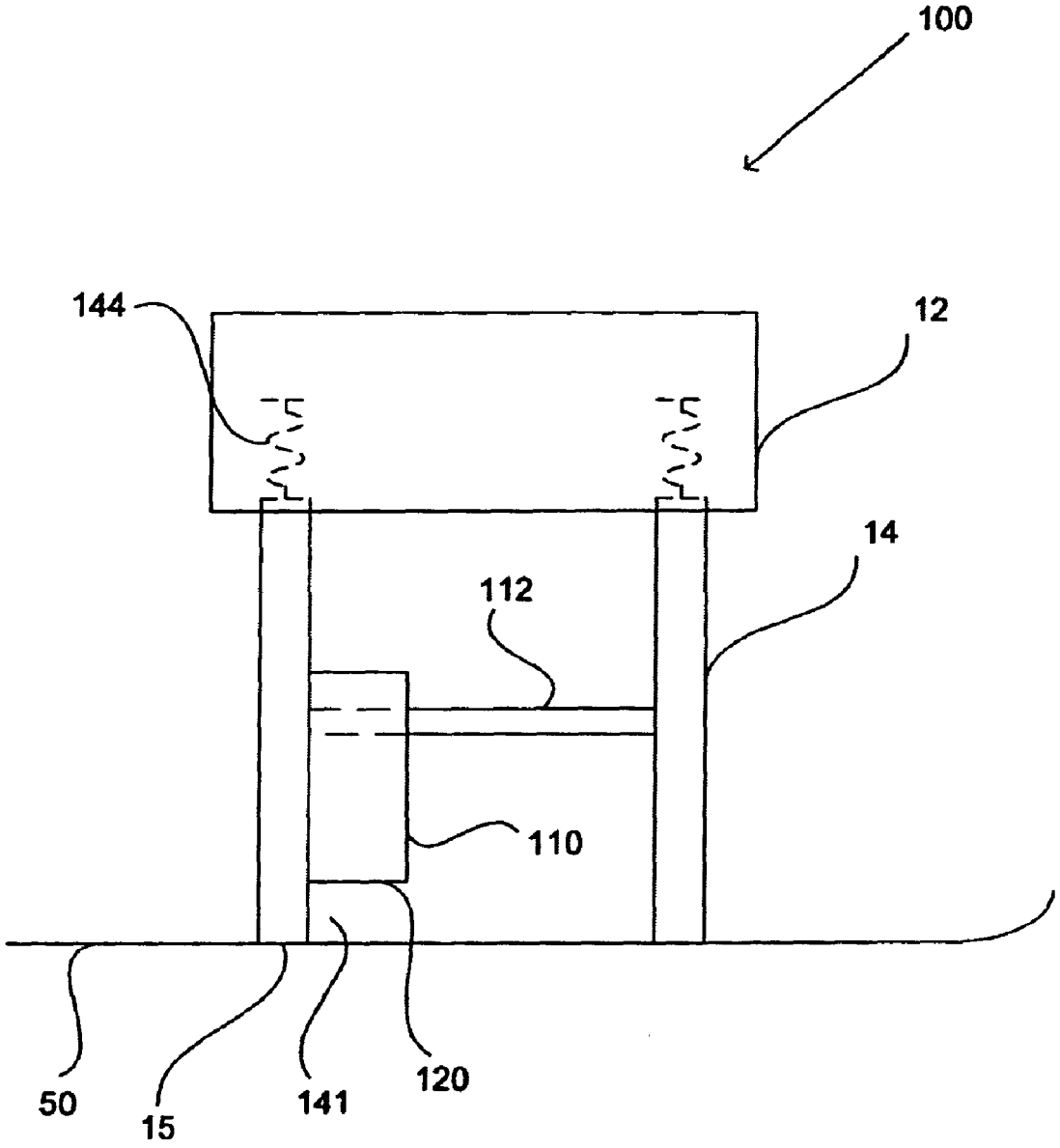
100
144
12
14
112
110
50
15
141
120

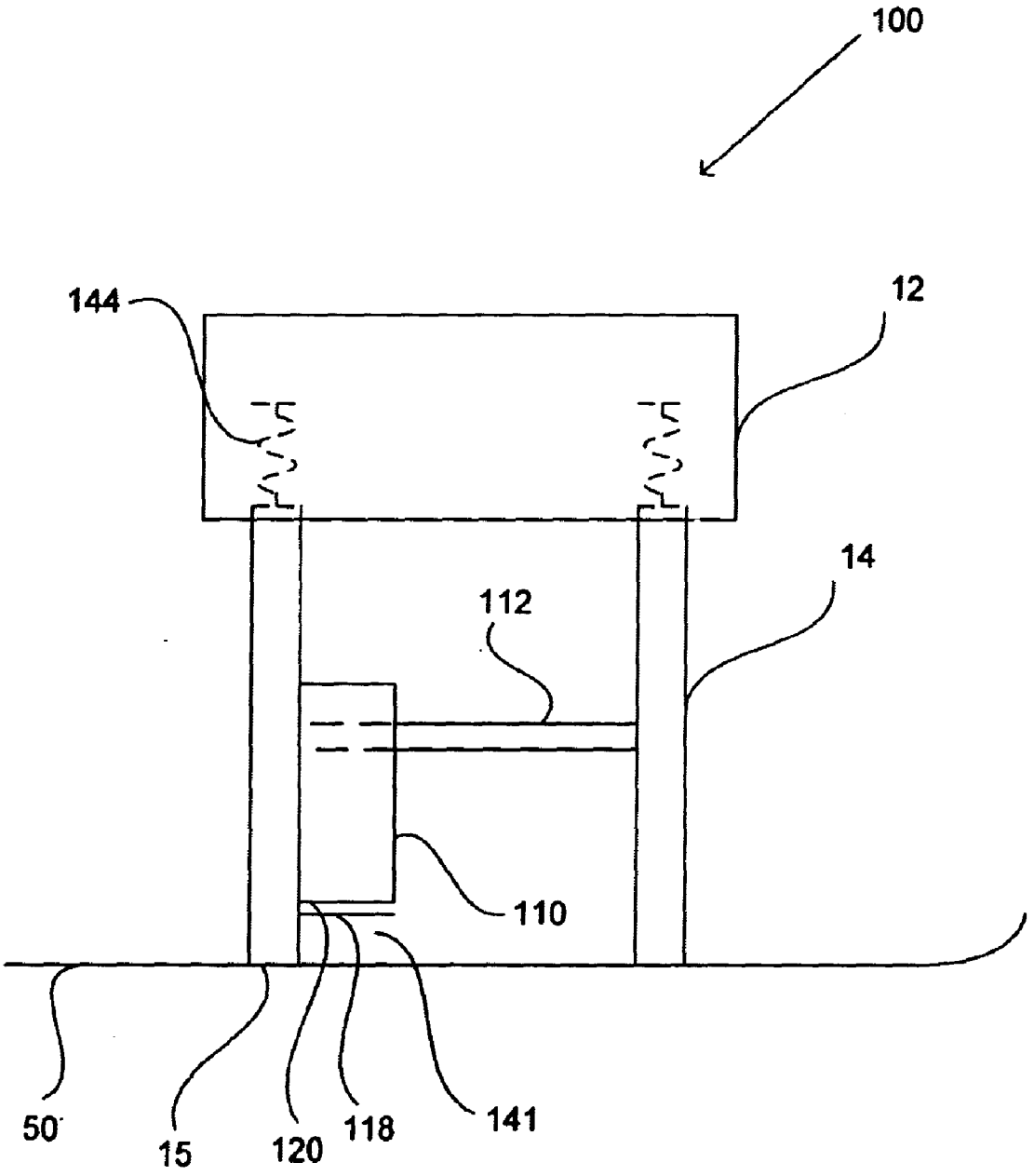
100
144
12
14
112
110
50
15
120
118
141

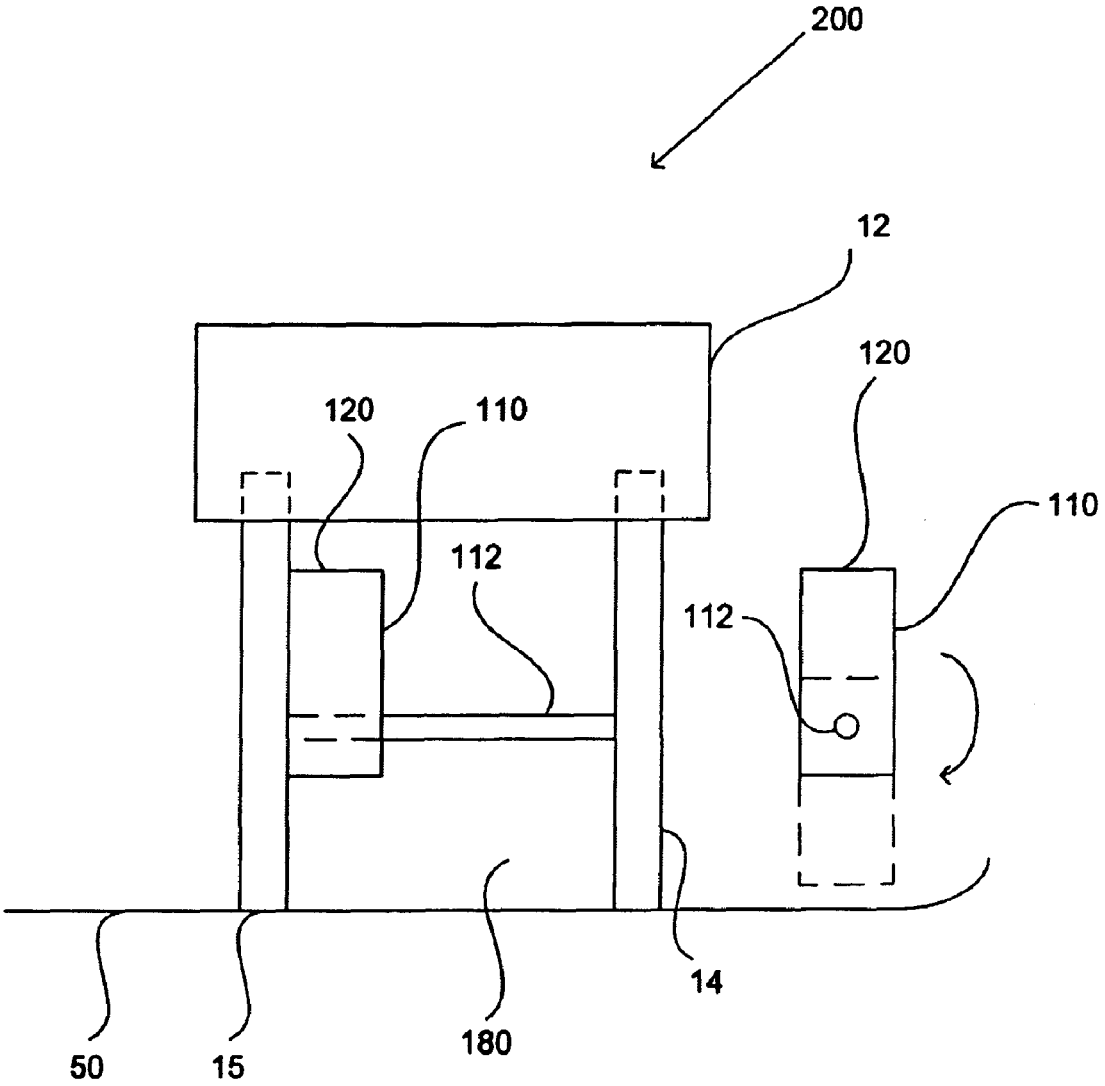
200
12
120
110
120
110
112
112
14
50
15
180

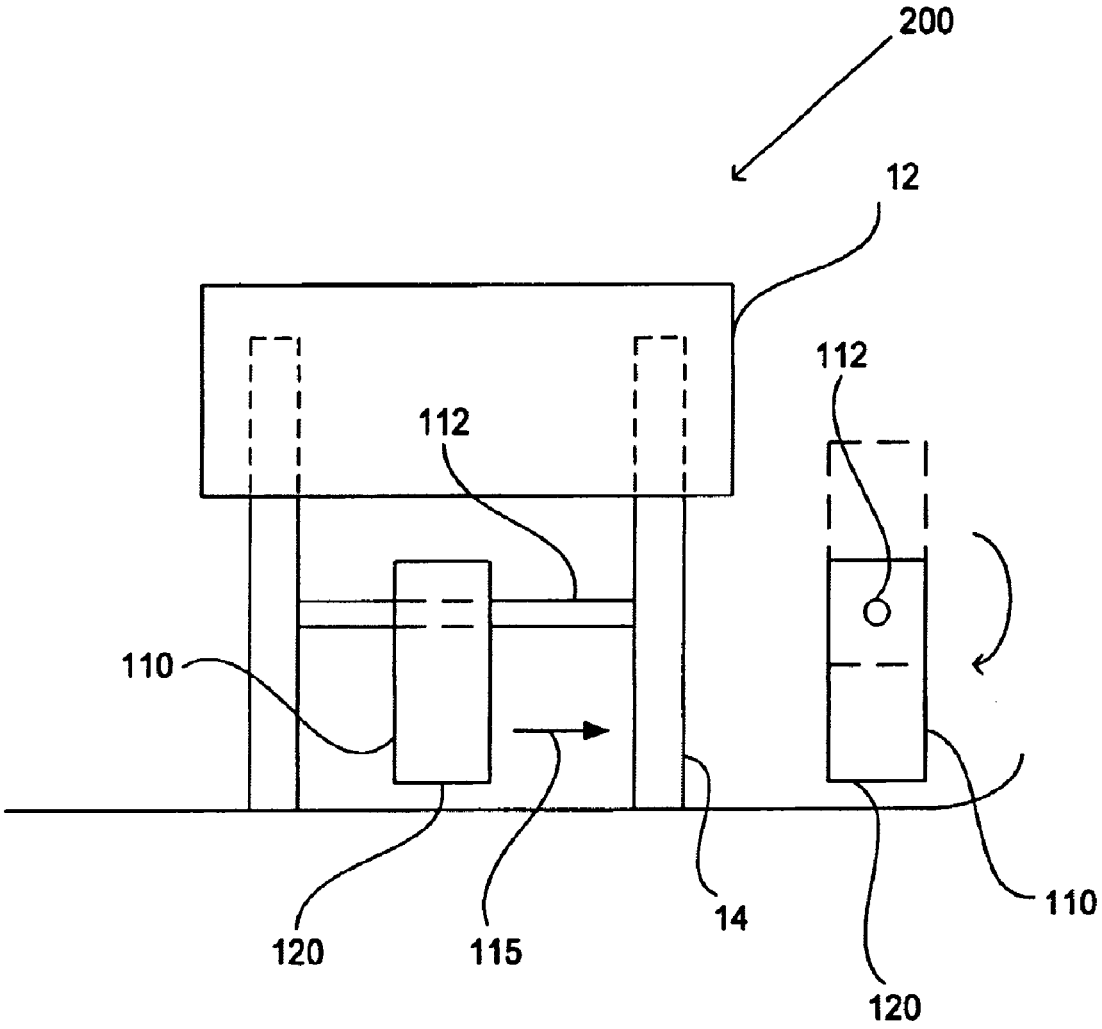
200
12
112
112
110
120
115
14
120
110

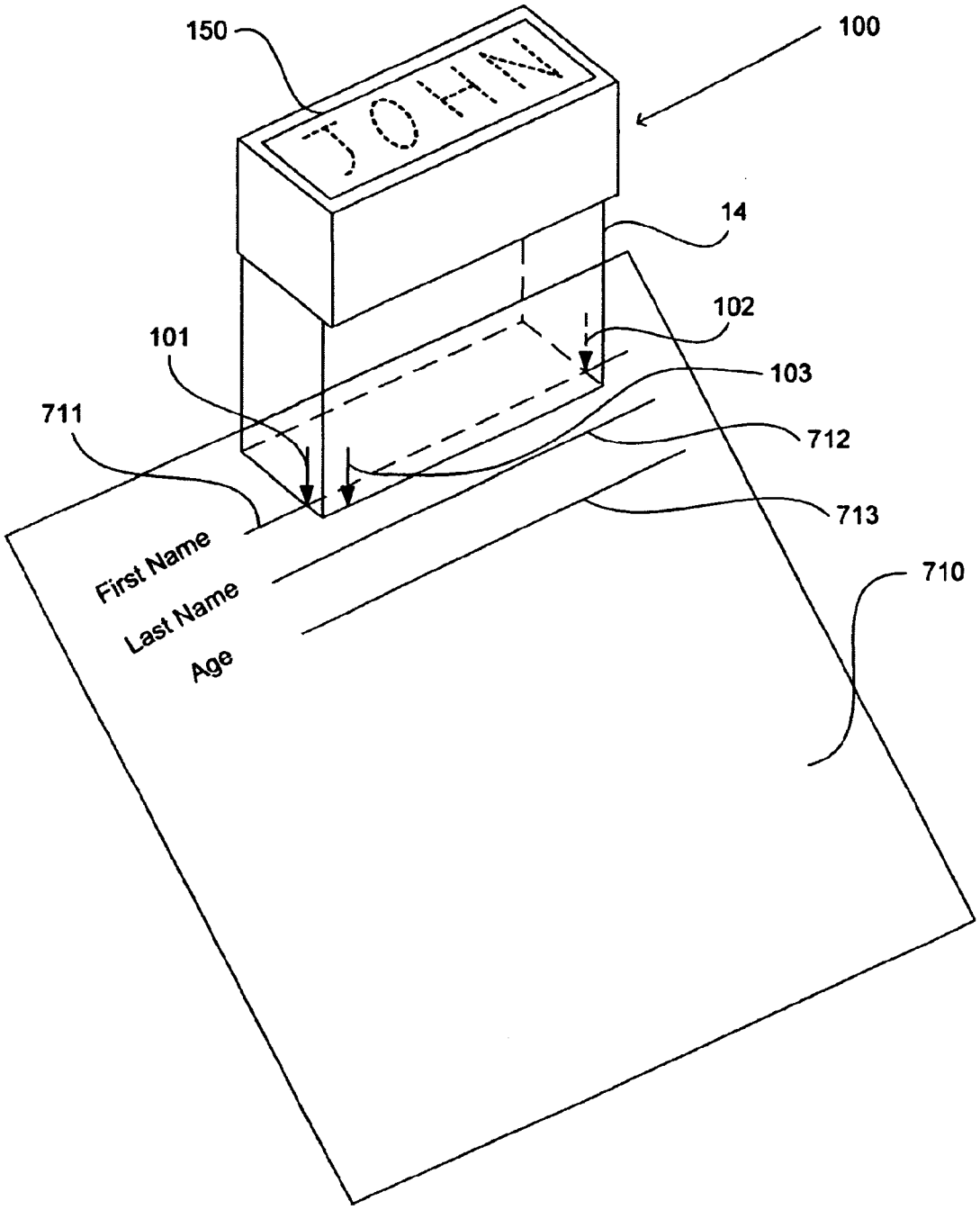
150
JOHN
100
14
102
101
103
711
712
713
First Name
Last Name
Age
710